United States Patent [19]

Adin et al.

[11] 4,195,998

[45] Apr. 1, 1980

[54] CO(III) COMPLEX CONTAINING RADIATION SENSITIVE ELEMENT WITH DIAZO RECORDING LAYER

[75] Inventors: Anthony Adin, Rochester; James C. Fleming, Webster, both of N.Y.

[73] Assignee: Eastman Kodak Company, Rochester, N.Y.

[21] Appl. No.: 846,240

[22] Filed: Oct. 27, 1977

Related U.S. Application Data

[60] Division continuation-in-part of Ser. No. 618,186, Sep. 30, 1975, abandoned, which is a continuation-inpart of Ser. No. 461,057, Apr. 15, 1974, abandoned.

[51] Int. Cl.[2] ..... G03C 1/52; G03C 1/72

[52] U.S. Cl. ..... 430/156; 430/502; 430/154

[58] Field of Search ..... 96/68, 29 R, 49, 75, 96/67, 88, 91 R

[56] References Cited

U.S. PATENT DOCUMENTS

| | | | |
|---|---|---|---|
| 1,897,843 | 2/1933 | Hickman et al. . | |
| 1,962,307 | 6/1934 | Hickman et al. . | |
| 2,084,420 | 6/1937 | Weyde . | |
| 2,774,669 | 12/1956 | Marron et al. | 96/49 |
| 2,884,326 | 4/1959 | Zemp . | |
| 3,152,903 | 10/1964 | Shepard . | |
| 3,284,201 | 11/1966 | Meijs et al. | 96/75 |
| 3,297,440 | 1/1967 | Delzenne . | |
| 3,353,984 | 11/1967 | Landau | 96/75 |
| 3,383,212 | 5/1968 | MacLachlan | 96/90 R |
| 3,418,118 | 5/1968 | McLachlan . | |
| 3,445,230 | 5/1969 | Francis . | |
| 3,469,984 | 9/1969 | Bialczak | 96/49 |
| 3,561,969 | 2/1971 | Burg | 96/90 R |
| 3,567,453 | 3/1971 | Borden | 96/91 R |
| 3,623,865 | 10/1971 | Case | 96/88 |
| 3,655,383 | 4/1972 | Shepard et al. | 96/48 PD |
| 3,658,534 | 4/1972 | Ishitani et al. | 96/88 |
| 3,679,415 | 7/1972 | McNally | 96/68 |
| 3,748,138 | 7/1973 | Bissonette | 96/66.3 |
| 3,754,914 | 8/1973 | Inoue et al. | 96/90 R |
| 3,765,883 | 10/1973 | Endo et al. | 96/1.5 |
| 3,847,619 | 12/1974 | Bissonette et al. | 96/67 |
| 3,849,138 | 11/1974 | Wyckoff | 96/68 |
| 3,856,524 | 12/1974 | Bissonette | 96/48 R |
| 3,880,659 | 4/1975 | Bailey et al. . | |
| 3,887,372 | 6/1975 | Bailey . | |
| 3,887,374 | 7/1975 | Schleigh et al. . | |

FOREIGN PATENT DOCUMENTS 1026357 4/1966 United Kingdom .

OTHER PUBLICATIONS

Kosar, J., "Light-Sensitive Systems", J. Wiley & Sons, 1965, p. 330.

*Primary Examiner*—Charles L. Bowers
*Attorney, Agent, or Firm*—Dana M. Schmidt

[57] ABSTRACT

A radiation-sensitive element is disclosed including a radiation-sensitive layer comprised of a cobalt(III)complex and a photoreductant. A process is disclosed in which the photoreductant is converted to a reducing agent by exposure to electromagnetic radiation longer than 300 nanometers. The reducing agent is then reacted with a cobalt(III)complex. Images can be recorded directly within the radiation-sensitive layer or in a separate image-recording element or layer by use of the residual cobalt(III)complex not exposed or one or more of the reaction products produced by exposure. By using the ammonia liberated from ammine ligand-containing cobalt(III)complexes on exposure in combination with imagewise and uniform exposures, positive or negative images can be formed in diazo image-recording layers or elements associated with the radiation-sensitive layer.

6 Claims, 7 Drawing Figures

CO(III) COMPLEX CONTAINING RADIATION SENSITIVE ELEMENT WITH DIAZO RECORDING LAYER

RELATION TO OTHER APPLICATIONS

This is a divisional and a continuation-in-part application of U.S. Ser. No. 618,186 filed on Sept. 30, 1975, now abandoned, which itself is a continuation-in-part application of U.S. Ser. No. 461,057 filed on Apr. 15, 1974, now abandoned.

The invention is directed to a process and element capable of forming a useful redox couple in response to actinic radiation in excess of 300 nanometers in wavelength. More specifically, this invention is directed to a photographic process and element capable of selectively generating a useful redox couple through the interaction of a cobalt(III) complex and a photoreductant. The present invention is further concerned with a photographic element and process capable of forming a photographic image in either a photographic element or layer containing the redox couple or in a separate, contiguous photographic element or layer.

Classically, photographic elements have incorporated silver halide as a radiation-sensitive material. Upon exposure and processing, the silver is reduced to its metallic form to produce an image. Processing, with its successive aqueous baths, has become increasingly objectionable to users desiring more immediate availability of a photographic image. Despite the processing required, silver halide photography has remained popular because it offers a number of distinct advantages. For example, although silver halide is itself photoresponsive only to blue and lower wavelength radiation, spectral sensitizers have been found which, without directly chemically interacting, are capable of transferring higher wavelength-radiation energy to silver halide to render it panchromatic. Additionally, silver halide photography is attractive because of its comparatively high speed. Frequently, silver halide is referred to as exhibiting internal amplification; i.e., the number of silver atoms reduced in imaging is a large multiple of the number of photons received.

A variety of nonsilver photographic systems have been considered by those skilled in the art. Typically, these systems have been chosen to minimize photographic processing and to provide useable photographic images with less delay than in silver halide photography. Characteristically, these systems require at least one processing step either to print or fix the photographic image. For example, ammonia or heat processing has been widely used in diazo imaging systems. While advantageously simple in terms of processing, these systems have, nevertheless, exhibited significant disadvantages. For example, many nonsilver systems are suitable for producing only negative images (or only positive images). Further, these systems have been quite slow because they have generally lacked the internal amplification capability of silver halide. Many systems have also suffered from diminishing image-background contrast with the passage of time.

The use of cobalt(III) complex compounds in photographic elements is generally known in the art. For example, Shepard et al U.S. Pat. No. 3,152,903 teaches imaging through the use of an oxidation-reduction reaction system that requires a photocatalyst. The solid reducing agent is taught to be any one of a number of hydroxy aromatic compounds, including dihydrophenols, such as hydroquinone. The oxidant is taught to be chosen from a variety of metals, such as silver, mercury, lead, gold, manganese, nickel, tin, chromium, platinum and copper. Shepard et al does not specifically teach the use of cobalt(III) complexes as oxidants. Instead, Shepard et al teaches that photochromic complexes, such as cobalt ammines, can be employed as photocatalysts to promote the oxidation-reduction reaction.

Cobalt(III) complexes are known to be directly responsive to electromagnetic radiation when suspended in solution. While most cobalt(III) complexes are preferentially responsive to ultraviolet radiation below about 300 nanometers, a number of cobalt(III) complexes have been observed in solution to be responsive to electromagnetic radiation ranging well into the visible spectrum. Unfortunately, these same complexes when incorporated into photographic elements lose or are diminished in their ability to respond directly to longer wavelength radiation. For example, Hickman et al in U.S. Pat. No. 1,897,843 teach mixing thioacetamide with hexamino cobaltic chloride to form a light-sensitive complex capable of interacting with lead acetate to produce a lead sulfide image. Hickman et al U.S. Pat. No. 1,962,307 teach mixing hexammine cobaltic chloride and citric acid to form a light-sensitive complex capable of bleaching a lead sulfide image. Weyde in U.S. Pat. No. 2,084,420 teaches producing a latent image by exposing $Co(NH_3)_2(NO_2)_4NH_4$ to light or an electrical current. A visible image can be formed by subsequent development with ammonium sulfide. In each of the above patents there is no photoreductant present.

Borden in U.S. Pat. No. 3,567,453, issued Mar. 2, 1971, and in his article "Review of Light-Sensitive Tetraarylborates", *Photographic Science and Engineering*, Volume 16, No. 4, July–August, 1972, discloses that aryl borate salts incorporating a wide variety of cations can be altered in solvent solubility upon exposure to actinic radiation. Borden demonstrates the general utility of aryl borate salts as radiation-sensitive compounds useful in forming differentially developable coatings, as is typical of lithography, by evaluating some 400 different cations ranging from organic cations, such as diazonium, acridinium and pyridinium salts, to inorganic cations, such as cobalt hexammine. Borden discloses that the aryl borate salts can be spectrally sensitized with a variety of sensitizers, including quinones. In its unsensitized form the cobalt hexammine tetraphenyl borate of Borden is reported to be light-sensitive in the range of from 290 to 430 nanometers. Borden notes in his report that hexammino cobalt chloride, although bright orange and therefore absorptive in the visible spectrum, is not useful in the lithographic system discussed in his article. Thus, Borden relies upon the light-sensitive aryl borate anionic moiety to provide radiation sensitivity.

In patent applications Ser. Nos. 384,858, now U.S. Pat. No. 3,887,372; 384,859, now U.S. Pat. No. 3,887,374; 384,860, now U.S. Pat. No. 3,880,659; and 384,861, now abandoned; all filed Aug. 2, 1973, it is taught to reduce tetrazolium salts and triazolium salts to formazan and azoamine dyes, respectively, employing in the presence of labile hydrogen atoms a photoreductant which is capable of forming a reducing-agent precursor upon exposure to actinic radiation. The reducing-agent precursor is converted to a reducing agent by a base, such as ammonia.

It is an object of this invention to provide a radiation-sensitive element and process capable of imagewise-forming, without processing, a redox couple useful in photographic imaging. It is a more specific object to provide elements and processes capable of producing positive or negative photographic images either in a radiation-sensitive layer or within a separate internal or external imaging layer. It is another object of this invention to provide photographic elements useful with only thermal processing. It is a specific object to provide a radiation-sensitive element exhibiting an internal amplification capability upon exposure.

These and other objects of this invention can be achieved in one aspect by providing a radiation-sensitive element comprising a support and, as a coating, a radiation-sensitive layer comprised of a cobalt(III) complex free of a sensitizable anion and a photoreductant capable of forming a redox couple with the cobalt(III) complex upon exposure to actinic radiation longer than 300 nanometers in wavelength.

In another aspect this invention is directed to a process comprising converting a photoreductant to a reducing agent by exposure to electromagnetic radiation of a wavelength longer than 300 nanometers. The reducing agent is then reacted with a cobalt(III) complex free of a sensitizable anion.

In still another aspect this invention is directed to a process comprising exposing a radiation-sensitive layer containing a photoreductant and a ligand-containing cobalt(III) complex to electromagnetic radiation of a wavelength longer than 300 nanometers to convert the photoreductant to a reducing agent. The radiation-sensitive layer is associated with an image-recording layer which is visibly responsive to at least one ligand contained within the cobalt(III) complex upon release thereof. The radiation-sensitive layer is then heated to stimulate reduction of the cobalt(III) complex with concomitant ligand release and transfer of the released ligand to the image-recording layer.

In an additional aspect, this invention is directed to a process of forming positive images by imagewise-exposing a radiation-sensitive layer containing a photoreductant and a cobalt(III) complex to radiation longer than 300 nanometers in wavelength to convert the photoreductant to a reducing agent. The radiation-sensitive layer is heated to stimulate reduction of the cobalt(III) complex in exposed areas. Thereafter, leuco dye means is introduced into the radiation-sensitive layer and the leuco dye means is imagewise-oxidized to a colored form by the cobalt(III) complex remaining in unexposed areas of the radiation-sensitive layer to form a positive image.

This invention can be better understood by reference to the following detailed description considered in conjunction with the accompanying drawings in which.

COBALT(III) COMPLEXES

Figure 1:
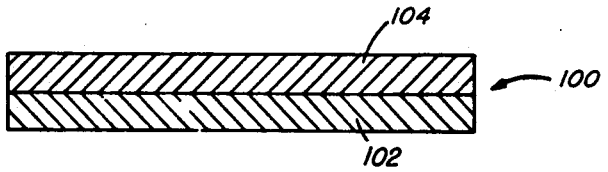
FIG. 1 is a schematic diagram of a radiation-sensitive element according to this invention.

The cobalt(III) complexes employed in the practice of this invention are those which feature a molecule having a cobalt atom or ion surrounded by a group of atoms, ions or other molecules which are generically referred to as ligands. The cobalt atom or ion in the center of these complexes is a Lewis acid, while the ligands are Lewis bases. While it is known that cobalt is capable of forming complexes in both its divalent and trivalent forms, trivalent cobalt complexes, i.e.,cobalt(III) complexes, are employed in the practice of this invention because the ligands are tenaciously held in these complexes as compared with corresponding cobalt(II) complexes. Preferred cobalt(III) complexes are those which are inert. Inert complexes are defined as those which, when a test sample thereof is dissolved at 0.1 molar concentration at 20° C. in an inert solvent solution also containing a 0.1 molar concentration of a tagged uncoordinated ligand of the same species as the coordinated ligand, exhibit essentially no exchange of uncoordinated and coordinated ligands for at least one minute, and preferably for at least several hours, such as up to five hours or more. This test is advantageously conducted under the conditions existing within the radiation-sensitive elements of this invention. Many cobalt(III) complexesshow essentially no change of uncoordinated or coordinated ligands for several days. The definition of inert complexes and the method of measuring ligand exchange using radioactive isotopes to tag ligands are well-known in the art. See, for example, Taube, Chem. Rev., Vol. 50, p. 69 (1952), and Basolo and Pearson, *Mechanisms of Inorganic Reactions, A Study of Metal Complexes and Solutions*, 2nd Edition, 1967, published by John Wiley and Sons, page 141. Further details on measurement of ligand exchange appear in articles by Adamson et al., *J. Am. Chem.* Vol. 73, p. 4789 (1951).

Preferred cobalt(III) complexes useful in the practice of this invention are those having a coordination number of 6. A wide variety of ligands can be used with cobalt(III) to form cobalt(III) complexes. Nearly all Lewis bases (i.e. substances having an unshared pair of electrons) can be ligands in cobalt(III)complexes. Some typical useful ligands include halides (e.g., chloride, bromide, fluoride), nitrate, nitrite, superoxide, water, amines (e.g., ethylenediamine, n-propylene diamine, diethylenetriamine, triethylenetetraamine, diaminodiacetate, ethylenediaminetetraacetic acid, etc.), ammine, azide, glyoximes, thiocyanate, cyanide, carbonate, and similar ligands, including those referred to on page 44 of Basolo et al, supra. It is also contemplated to employ cobalt(III) complexes incorporating as ligands Schiff bases, such as those disclosed in German OLS Pat. Nos. 2,052,197 and 2,052,198.

The cobalt(III) complexes useful in the practice of this invention are those which are free of sensitizable anions. In one form the cobalt(III) complex can be a neutral compound which is entirely free of either anions or cations. The cobalt(III) complexes can include one or more cations or nonsensitizable anions as determined by the charge-neutralization rule. Useful cations are those which produce readily solubilizable cobalt(III)

complexes, such as alkali and quaternary ammonium cations. Anions are considered to be sensitizable for purposes of this invention if their use in combination with known sensitizers for silver halide emulsions stimulates their photographic response upon exposure to electromagnetic radiation longer than 300 nanometers in wavelength. Such anions can, of course, be readily identified to be sensitized by observing their behavior in any one of the tests sets forth in the aforesaid Bordon patent, in combination with photolytically inactive cations with and without known spectral sensitizers being present. Especially useful with cobalt(III) complexes are nonsensitizable anions, such as halides (e.g., chloride, bromide, fluoride, etc.), sulfite, sulfate, alkyl or aryl sulfonates, nitrate, nitrite, perchlorate, carboxylates (e.g., halocarboxylates, acetate, hexanoate, etc.), hexafluorophosphate, tetrafluoroborate, as well as other, similar, nonsensitizable anions. Highly preferred cobalt(III) complexes are those which, in accordance with the charge-neutralization rule, incorporate nonsensitizable anions having a net negative charge of 3.

In systems of the type disclosed by Thap DoMinh in concurrently filed, commonly assigned patent application Ser. No. 461,172, now abandoned, titled *HIGH GAIN TRANSITION METAL COMPLEX IMAGING*, cobalt(III) complexes incorporating anions of acids having pKa values of 3.5 or less (preferably from 3.0 to 0.0), when employed with certain compounds containing conjugated $\pi$-bonding systems capable of forming Co(III) ligands, exhibit remarkable increases in imaging capabilities, probably due to catalysis of image-producing cobalt(III) complex generation.

Exemplary preferred cobalt(III) complexes useful in the practice of this invention are those set forth in Table I.

TABLE 1

| Exemplary Preferred Cobalt(III) Complexes | |
|---|---|
| C- 1 | hexa-ammine cobalt(III) acetate |
| C- 2 | hexa-ammine cobalt(III) thiocyanate |
| C- 3 | hexa-ammine cobalt(III) trifluoroacetate |
| C- 4 | chloropenta-ammine cobalt(III) bromide |
| C- 5 | bromopenta-ammine cobalt(III) bromide |
| C- 6 | aquopenta-ammine cobalt(III) nitrite |
| C- 7 | bis(ethylenediamine) di-ammine cobalt-(III) perchlorate |
| C- 8 | bis(ethylenediamine) diacetato cobalt-(III) chloride |
| C- 9 | triethylenetetramine dichloro cobalt(III) acetate |
| C-10 | bis(methylamine) tetra-ammine cobalt(III) hexafluorophosphate |
| C-11 | aquopenta(methylamine) cobalt(III) nitrate |
| C-12 | chloropenta(ethylamine) cobalt(III) chloride |
| C-13 | trinitrotris-ammine cobalt(III) |
| C-14 | trinitrotris(methylamine) cobalt(III) |
| C-15 | tris(ethylenediamine) cobalt(III) acetate |
| C-16 | tris(1,3-propanediamine) cobalt(III) trifluoroacetate |
| C-17 | bis(dimethylglyoxime) bispyridine cobalt-(III) trichloroacetate |
| C-18 | N,N'-ethylenebis(salicylideneimine) bis-ammine cobalt(III) bromide |
| C-19 | bis(dimethylglyoxime) ethylaquo cobalt-(III) |
| C-20 | $\mu$-superoxodeca-ammine dicobalt(III) perchlorate |
| C-21 | sodium dichloro ethylenediamine diacetato cobalt(III) |
| C-22 | penta-ammine carbonato cobalt(III) nitrite |
| C-23 | tris(glycinato) cobalt(III) |
| C-24 | trans[bis(ethylenediamine) chlorothio-cyanato cobalt(III)] sulfite |
| C-25 | trans[bis(ethylenediamine) diazido cobalt(III)] chloride |
| C-26 | cis[bis(ethylendiamine) ammine azido cobalt(III)] hexanoate |
| C-27 | tris(ethylenediamine) cobalt(III) chloride |
| C-28 | trans[bis(ethylenediamine) dichloro cobalt(III)] chloride |
| C-29 | bis(ethylenediamine) dithiocyanato cobalt(III) fluoride |
| C-30 | triethylenetetramine dinitro cobalt-(III) iodide |
| C-31 | tris(ethylenediamine) cobalt(III) 2-pyridylcarboxylate |

Photoreductants

As employed herein, the term "photoreductant" designates a material capable of molecular photolysis or photo-induced rearrangement to generate a reducing agent, which forms a redox couple with the cobalt(III) complex. The reducing agent spontaneously or with the application of heat reduces the cobalt(III) complex. The photoreductants employed in the practice of this invention are to be distinguished from spectral sensitizers, such as those disclosed in commonly assigned, concurrently filed patent application Ser. No. 461,171, now abandoned, titled "Spectral Sensitization of Transition Metal Complexes". While spectral sensitizers may in fact form a redox couple for the reduction of cobalt(III) complexes (although this has not been confirmed), such sensitizers must be associated with the cobalt(III) complex concurrently with receipt of actinic radiation in order for cobalt(III) complex reduction to occur. By contrast, when a photoreductant is first exposed to actinic radiation and thereafter associated with a cobalt(III) complex, reduction of the cobalt(III) complex still occurs.

Any photoreductant as defined above can be usefully employed in the practice of this invention. A variety of compounds are known in the art to be photoreductants. For example, diazonium salts are known photoreductants. In copending, commonly assigned patent applications Ser. Nos. 384,858, 384,859, 384,860 and 384,861, cited above and here incorporated by reference, a large variety of photoreductants are disclosed which are useful in the practice of this invention. We have observed metal carbonyl, e.g., benzene chromium tricarbonyl; $\beta$-ketosulfide, e.g., 2-(4-totylthio)-chromanone; diketone, e.g., furil; carboxylic acid azide, e.g., 4-bromo-1-hydroxy-2-naphthoic acid azide; organic benzilate, e.g., N-methylacridinium benzilate; dipyridinium salt, e.g., N,N'-bis(2,4-dinitrophenyl)-4,4'-dipyridinium hexafluorophosphate; diazonaphthone, e.g., 4-diazo-2-methyl-1-naphthone; phenazine; phenazine-N-oxide; quinone; disulfide; diazoanthrone; diazonium salt; diazophenanthrone and aromatic azide; carbazide; and diazosulfonate photoreductants to be particularly preferred for use in the practice of this invention.

The disulfide photoreductants of this invention are preferably aromatic di-sulfides containing one or two aromatic groups attached to the sulfur atoms. The non-aromatic group can take a variety of forms, but is preferably a hydrocarbon group, such as an alkyl grouphaving from 1 to 20 (preferably 1 to 6) carbon atoms. The aromatic groups of the di-sulfide, azide, carbazide and diazosulfonate photoreductants can be either single or fused carbocyclic aromatic ring structures, such as phenyl, naphthyl, anthryl, etc. They can, alternatively, incorporate heterocyclic aromatic ring structures, such as those having 5- or 6-membered aromatic rings including oxygen, sulfur or nitrogen heteroatoms. The aromatic rings can, of course, bear a variety of substituents. Exemplary of specifically contemplated ring substituents are lower alkyl (i.e., 1 to 6 carbon atoms), lower alkenyl (i.e., 2 to 6 carbon atoms), lower alkynyl (i.e., 2 to 6 carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., methylsulfonyl, phenylsulfonyl), sulfoxy sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methyl mercapto) substituents.

Specific exemplary di-sulfides, diazoanthrones, diazophenanthrones, aromatic carbazides, aromatic azides, diazonium salts and aromatic diazosulfonates are set forth in Table II.

TABLE II

| Exemplary Photoreductants | |
|---|---|
| PR- 1 | 1-naphthyl disulfide |
| PR- 2 | β-naphthyl disulfide |
| PR- 3 | 9-anthryl disulfide |
| PR- 4 | cyclohexyl 2-naphthyl disulfide |
| PR- 5 | diphenylmethyl 2-napthyl disulfide |
| PR- 6 | 2-dodecyl 1'-naphthyl disulfide |
| PR- 7 | thioctic acid |
| PR- 8 | 2,2'-bis(hydroxymethyl)diphenyl disulfide |
| PR- 9 | 10-diazoanthrone |
| PR-10 | 2-methoxy-10-diazoanthrone |
| PR-11 | 3-nitro-10-diazoanthrone |
| PR-12 | 3,6-diethoxy-10-diazoanthrone |
| PR-13 | 3-chloro-10-diazoanthrone |
| PR-14 | 4-ethoxy-10-diazoanthrone |
| PR-15 | 4-(1-hydroxyethyl)-10-diazoanthrone |
| PR-16 | 2,7-diethyl-10-diazoanthrone |
| PR-17 | 9-diazo-10-phenanthrone |
| PR-18 | 3,6-dimethyl-9-diazo-10-phenanthrone |
| PR-19 | 2,7-dimethyl-9-diazo-10-phenanthrone |
| PR-20 | 4-azidonbenzoic acid |
| PR-21 | 4-nitrophenyl azide |
| PR-22 | 4-dimethylaminophenyl azide |
| PR-23 | 2,6-di-4-azidonbenzylidene-4-methylcyclohexanone |
| PR-24 | 2-azido-1-octylcarbamooyl-benzimidazole |
| PR-25 | 2,5-bis(4-azidophenyl)-1,3,4-oxadiazole |
| PR-26 | 1-azido-4-methoxynaphthalene |
| PR-27 | 2-carbazido-1-naphthol |
| PR-28 | 3,3'-dimethoxy-4,4'-diazidobiphenyl |
| PR-29 | 4-diethylaminobenzenediazonium tetrafluoroborate |
| PR-30 | 2,5-dimethoxybenzenediazonium tetrafluoroborate |
| PR-31 | 2,5-diethoxybenzenediazonium tetrafluoroborate |
| PR-32 | 2,5-diethoxy-4-morpholinobenzenediazonium tetrafluoroborate |
| PR-33 | 4-chloro-2,5-diethoxybenzenediazonium tetrafluoroborate |
| PR-34 | 4-dimethylaminobenzenediazonium tetrafluoroborate |
| PR-35 | 2-ethoxy-4-diethylaminobenzenediazonium tetrafluoroborate |
| PR-36 | 4-(ethylamino)benzenediazonium tetrafluoroborate |
| PR-37 | 4-[bis(hydroxypropyl)amino]benzenediazonium tetrafluoroborate |
| PR-38 | 2-ethoxy-4-diethylaminobenzenediazonium tetrafluoroborate |
| PR-39 | 4-(N-methyl-N-allylamino)benzenediazonium tetrafluoroborate |
| PR-40 | 4-(diamylamino)benzenediazonium tetrafluoroborate |
| PR-41 | 2-methyl-4-diethylaminobenzenediazonium tetrafluoroborate |
| PR-42 | 4-(oxazolidino)benzenediazonium tetrafluoroborate |
| PR-43 | 4-(cylcohexylamino)benzenediazonium tetrafluoroborate |
| PR-44 | 2-nitro-4-morpholinobenzenediazonium hexafluorophosphate |
| PR-45 | 4-(9-carbazoyl)benzenediazonium hexfluorophosphate |
| PR-46 | 4-(dihydroxymethylamino)-3-methylbenzenediazonium hexafluorophosphate |
| PR-47 | 4-diethylaminobenzenediazonium hexachlorostannate |
| PR-48 | 4-dimethylamino-3-methylbenzenediazonium hexachlorostannate |
| PR-49 | 2-methyl-4-(N-methyl-N-hydroxypropylamino)benzenediazonium hexachlorostannate |
| PR-50 | 4-dimethylaminobenzenediazonium tetrachlorozincate |
| PR-51 | 4-dimethylamino-3-ethoxybenzenediazonium chlorozincate |
| PR-52 | 4-diethylaminobenzenediazonium tetrachlorozincate |
| PR-53 | 4-diethylaminobenzenediazonium hexafluorophosphate |
| PR-54 | 2-carboxy-4-dimethylaminobenzenediazonium hexafluorophosphate |
| PR-55 | 3-(2-hydroxyethyoxy)-4-pyrrolidinobenzenediazonium hexafluorophosphate |
| PR-56 | 4-methoxybenzenediazonium hexafluorophosphate |
| PR-57 | 2,5-diethoxy-4-acetamidobenzenediazonium hexafluorophosphate |
| PR-58 | 4-methylamino-3-ethoxy-6-chlorobenzenediazonium hexafluorophosphate |
| PR-59 | 3-methoxy-4-diethylamiobenzenediazonium hexafluorophosphate |
| PR-60 | 2,5-dichloro-4-benzylaminobenzenediazonium hexafluorophosphate |
| PR-61 | 4-phenylaminobenzenediazonium hexafluorophosphate |
| PR-62 | 4-(tert.-butylamino)benzenediazonium hexafluorophosphate |
| PR-63 | 4-morpholinobenzenediazonium hexafluorophosphate |
| PR-64 | 4-morpholino-3-methoxybenzenediazonium hexafluorophosphate |
| PR-65 | 1-piperidinoisquinolin-4-yldiazonium hexafluorophosphate |
| PR-66 | 4-morpholino-2,5-dimethoxy benzenediazonium hexafluorophosphate |
| PR-67 | 4-morpholino-2-ethoxy-5-methoxybenzenediazonium hexafluorophosphate |
| PR-68 | 4-(4-methoxyphenylamino)benzenediazonium chlorozincate |
| PR-69 | 4-morpholino-2,5-dibutoxybenzenediazonium chlorozincate |
| PR-70 | 2,5-diethoxy-4-benzoylaminobenzenediazonium chlorozincate |
| PR-71 | 2,5-dibutoxy-4-benzoylaminobenzenediazonium chlorozincate |
| PR-72 | 4-ethylmercapto-2,5-diethoxybenzenediazonium chlorozincate |
| PR-73 | 4-tolymercapto-2,5-diethoxybenzenediazonium chlorozincate |
| PR-74 | potassium 4-(N-ethyl-N-hydroxyethylamino)-benzenediazosulfonate |
| PR-75 | sodium 4-(diethylamino)benzenediazosulfonate |
| PR-76 | potassium 2-chloro-4-morpholinobenzenediazosulfonate |
| PR-77 | tetramethylammonium 3-methoxy-4-piper- |

TABLE II-continued

| Exemplary Photoreductants |
|---|
| idinobenzenediazosulfonate |

Quinones are useful as photoreductants in the practice of this invention. Preferred quinones include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, aralkoxy, alkaryloxy, hydroxyalkyl, hydroxyalkoxy, alkoxyalkyl, acyloxyalkyl, aryloxyalkyl, aroyloxyalkyl, aryloxyalkoxy, alkylcarbonyl, carboxyl, primary and secondary amino, aminoalkyl, amidoalkyl, anilino, piperidino, pyrrolidino, morpholino, nitro, halide and other similar substituents. Such aryl substituents are preferably phenyl substituents and such alkyl, alkenyl and alkynyl substituents, whether present as sole substituents or present in combination with other atoms, typically incorporate 20 (preferably 6) or fewer carbon atoms.

Specific exemplary quinones intended to be used in combination with a separate source of labile hydrogen atoms are set forth in Table III.

TABLE III

| | Exemplary Quinones Useful with External Hydrogen Source |
|---|---|
| PR-78 | 2,5-dimethyl-1,4-benzoquinone |
| PR-79 | 2,6-dimethyl-1,4-benzoquinine |
| PR-80 | duroquinone |
| PR-81 | 2-(1-formyl-1-methylethyl)-5-methyl-1,4-benzoquinone |
| PR-82 | 2-methyl-1,4-benzoquinone |
| PR-83 | 2-phenyl-1,4-benzoquinone |
| PR-84 | 2,5-dimethyl-6-(1-formylethyl)-1,4-benzoquinone |
| PR-85 | 2-(2-cyclohexanoyl)-3,6-dimethyl-1,4-benzoquinone |
| PR-86 | 1,4-naphthoquinone |
| PR-87 | 2-methyl-1,4-naphthoquinone |
| PR-88 | 2,3-dimethyl-1,4-naphthoquinone |
| PR-89 | 2,3-dichloro-1,4-naphthoquinone |
| PR-90 | 2-thiomethyl-1,4-naphthoquinone |
| PR-91 | 2-(1-formyl-2-propyl)-1,4-naphthoquinone |
| PR-92 | 2-(2-benzolethyl)-1,4-naphthoquinone |
| PR-93 | 9,10-phenanthrenequinone |
| PR-94 | 2-tert-butyl-9,10-anthraquinone |
| PR-95 | 2-methyl-1,4-anthraquinone |
| PR-96 | 2-methyl-9,10-anthraquinone |

A preferred class of photoreductants are internal hydrogen-source quinones, that is, quinones incorporating labile hydrogen atoms. These quinones are more easily photoreduced that quinones which do not incorporate labile hydrogen atoms. Even when quinones lacking labile hydrogen atoms are employed in combination with an external source of hydrogen atoms while incorporated hydrogen source quinones are similarly employed without external hydrogen-source compounds, the internal hydrogen-source quinones continue to exhibit greater ease of photoreduction. When internal hydrogen-source quinones are employed with external hydrogen-source compounds, their ease of photoreduction can generally be further improved, although the improvement is greater for those internal hydrogen-source quinones which are less effective when employed without an external hydrogen-source compound.

Using quinones exhibiting greater ease of photoreduction results in photographic elements which exhibit improved image densities for comparable exposures and which produce comparable image densities with lesser exposure times. Hence, internal hydrogen-source quinones can be employed to achieve greater photographic speeds and/or image densities.

Particularly preferred internal hydrogen-source quinones are 5,8-dihydro-1,4-naphthoquinones having at least one hydrogen atom in each of the 5 and 8 ring positions. Other preferred incorporated hydrogen-source quinones are those which have a hydrogen atom bonded to a carbon atom to which is also bonded the oxygen atom of an oxy substituent or a nitrogen atom of an amine substituent with the further provision that the carbon to hydrogen bond is the third or fourth bond removed from at least one quinone carbonyl double bond. As employed herein, the term "amine substituent" is inclusive of amide and imine substituents. Disubstituted amino substituents are preferred. 1,4-Benzoquinones and naphthoquinones having one or more 1'- or 2'-hydroxyalkyl, alkoxy (including alkoxyalkoxy—particularly 1'- or 2'-alkoxyalkoxy, hydroxyalkoxy, etc.), 1'- or 2'-alkoxyalkyl, aralkoxy, 1'- or 2'-acyloxyalkyl, 1'- or 2'-aryloxyalkyl, aryloxyalkoxy, 1'- or 2'-aminoalkyl (preferably a 1'- or 2'-aminoalkyl in which the amino group contains two substituents in addition to the alkyl substituent), 1'- or 2'-aroyloxyalkyl, alkylarylamino, dialkylamino, N,N-bis-(1-cyanoalkyl)amino, N-aryl-N-(1-cyanoalkyl)amino, N-alkyl-N-(1-cyanoalkyl)amino, N,N-bis(1-carbalkoxyalkyl)amino, N-aryl-N-(1-carbalkoxyalkyl)amino, N-alkyl-N-(1-carbalkoxyalkyl)amino, N,N-bis(1-nitroalkyl)amino, N-alkyl-N-(1-nitroalkyl-)amino, N-aryl-N-(1-nitroalkyl)amino, N,N-bis(1-acylalkyl)amino, N-alkyl-N-(1-acylalkyl)amino, N-aryl-N-(1-acylalky)amino, pyrrolino, pyrrolidino, piperidino, and/or morpholino substituents in the 2 and/or 3 position are particularly preferred. Other substituents can, of course, be present. Unsubstituted 5,8-dihydro-1,4-naphthoquinone and 5,8-dihydro-1,4-naphthoquinones substituted at least in the 2 and/or 3 position with one or more of the above-listed preferred quinone substituents also constitute preferred internal hydrogen-source quinones. It is recognized that additional fused rings can be present within the incorporated hydrogen-source quinones. For example, 1,4-dihydro-anthraquinones represent a useful species of 5,8-dihydro-1,4-naphthoquinones useful as incorporated hydrogen-source quinones. The aryl substituents and substituent moieties of incorporated hydrogen-source quinones are preferably phenyl or phenylene, while the aliphatic hydrocarbon substituents and substituent moieties preferably incorporate twenty or fewer carbon atoms and, most preferably, six or fewer carbon atoms. Exemplary preferred internal hydrogen-source quinones are set forth in Table IV.

TABLE IV

| | Exemplary Internal Hydrogen Source Quinones |
|---|---|
| PR-97 | 5,8-dihydro-1,4-naphthoquinone |
| PR-98 | 5,8-dihydro-2,5,8-trimethyl-1,4-naphthoquinone |
| PR-99 | 2,5-bis(dimethylamino)-1,4-benzoquinone |
| PR-100 | 2,5-dimethyl-3,6-bis(dimethylamino)-1,4-benzoquinone |
| PR-101 | 2,5-dimethyl-3,6-bispyrrolidino-1,4-benzoquinone |

TABLE IV-continued

| Exemplary Internal Hydrogen Source Quinones | |
|---|---|
| PR-102 | 2-ethoxy-5-methyl-1,4-benzoquinone |
| PR-103 | 2,6-dimethoxy-1,4-benzoquinone |
| PR-104 | 2,5-dimethoxy-1,4-benzoquinone |
| PR-105 | 2,6-diethoxy-1,4-benzoquinone |
| PR-106 | 2,5-diethoxy-1,4-benzoquinone |
| PR-107 | 2,5-bis(2-methoxyethoxy)-1,4-benzoquinone |
| PR-108 | 2,5-bis(β-phenoxyethoxy)-1,4-benzoquinone |
| PR-109 | 2,5-diphenethoxy-1,4-benzoquinone |
| PR-110 | 2,5-di-n-propoxy-1,4-benzoquinone |
| PR-111 | 2,5-di-isopropoxy-1,4-benzoquinone |
| PR-112 | 2,5-di-n-butoxy-1,4-benzoquinone |
| PR-113 | 2,5-di-sec-butoxy-1,4-benzoquinone |
| PR-114 | 1,1'-bis(5-methyl-1,4-benzoquinone-2-yl)-diethyl ether |
| PR-115 | 2-methyl-5-morpholinomethyl-1,4-benzoquinone |
| PR-116 | 2,3,5-trimethyl-6-morpholinomethyl-1,4 benzoquinone |
| PR-117 | 2,5-bis(morpholinomethyl)-1,4-benzoquinone |
| PR-118 | 3-hydroxymethyl-3,5,6-trimethyl-1,4-benzoquinone |
| PR-119 | 2-(1-hydroxyethyl)-5-methyl-1,4-benzoquinone |
| PR-120 | 2-(1-hydroxy-n-propyl)-5-methyl-1,4-benzoquinone |
| PR-121 | 2-(1-hydroxy-2-methyl-n-propyl)-5-methyl-1,4-benzoquinone |
| PR-122 | 2-(1,1-dimethyl-2-hydroxyethyl) -5-methyl-1,4-benzoquinone |
| PR-123 | 2-(1-acetoxyethyl)-5-methyl-1,4-benzoquinone |
| PR-124 | 2-(1-methoxyethyl)-5-methyl-1,4-benzoquinone |
| PR-125 | 2-(2-hydroxyethyl)-3,5,6-trimethyl-1,4-benzoquinone |
| PR-126 | 2-ethoxy-5-phenyl-1,4-benzoquinone |
| PR-127 | 2-i-propoxy-5-phenyl-1,4-benzoquinone |
| PR-128 | 1,4-dihydro-1,4-dimethyl-9,10-anthraquinone |
| PR-129 | 2-dimethylamino-1,4-naphthoquinone |
| PR-130 | 2-methoxy-1,4-naphthoquinone |
| PR-131 | 2-benzyloxy-1,4-napthoquinone |
| PR-132 | 2-methoxy-3-chloro-1,4-naphthoquinone |
| PR-133 | 2,3-dimethoxy-1,4-naphthoquinone |
| PR-134 | 2,3-diethoxy-1,4-naphthoquinone |
| PR-135 | 2-ethoxy-1,4-naphthoquinone |
| PR-136 | 2-phenethoxy-1,4-naphthoquinone |
| PR-137 | 2-(2-methoxyethoxy)-1,4-naphthoquinone |
| PR-138 | 2-(2-ethoxyethoxy)-1,4-naphthoquinone |
| PR-139 | 2-(2-phenoxy)ethoxy-1,4-naphthoquinone |
| PR-140 | 2-ethoxy-5-methoxy-1,4-naphthoquinone |
| PR-141 | 2-ethoxy-6-methoxy-1,4-naphthoquinone |
| PR-142 | 2-ethoxy-7-methoxy-1,4-naphthoquinine |
| PR-143 | 2-n-propoxy-1,4-naphthoquinone |
| PR-144 | 2-(3-hydroxypropoxy)-1,4-naphthoquinone |
| PR-145 | 2-isopropoxy-1,4-naphthoquinone |
| PR-146 | 7-methoxy-2-isopropoxy-1,4-naphthoquinone |
| PR-147 | 2-n-butoxy-1,4-naphthoquinone |
| PR-148 | 2-sec-butoxy-1,4-napthoquinone |
| PR-149 | 2-n-pentoxy-1,4-naphthoquinone |
| PR-150 | 2-n-hexoxy-1,4-naphthoquinone |
| PR-151 | 2-n-heptoxy-1,4-naphthoquinone |
| PR-152 | 2-acetoxymethyl-3-methyl-1,4-naphthoquinone |
| PR-153 | 2-methoxymethyl-3-methyl-1,4-naphthoquinone |
| PR-154 | 2-(β-acetoxyethyl)-1,4-naphthoquinone |
| PR-155 | 2-N,N-bis(cyanomethyl)aminoethyl-3-methyl-1,4-naphthoquinone |
| PR-156 | 2-methyl-3-morpholinomethyl-1,4-naphthoquinone |
| PR-157 | 2-hydroxymethyl-1,4-naphthoquinone |
| PR-158 | 2-hydroxymethyl-3-methyl-1,4-naphthoquinone |
| PR-159 | 2-(1-hydroxyethyl)-1,4-naphthoquinone |
| PR-160 | 2-(2-hydroxyethyl)-1,4-napthoquinone |
| PR-161 | 2-(1,1-dimethyl-2-hydroxyethyl)-1,4-naphthoquinone |
| PR-162 | 2-bromo-3-isopropoxy-1,4-naphthoquinone |
| PR-163 | 2-ethoxy-3-methyl-1,4-naphthoquinone |

TABLE IV-continued

| Exemplary Internal Hydrogen Source Quinones | |
|---|---|
| PR-164 | 2-chloro-3-piperidino-1,4-naphthoquinone |
| PR-165 | 2-morpholino-1,4-naphthoquinone |
| PR-166 | 2,3-dipiperidino-1,4-naphthoquinone |
| PR-167 | 2-dibenzylamino-3-chloro-1,4-napthoquinone |
| PR-168 | 2-methyloxycarbonylmethoxy-1,4-naphthoquinone |
| PR-169 | 2-(N-ethyl-N-benzylamino)-3-chloro 1,4-napthoquinone |
| PR-170 | 2-morpholino-3-chloro-1,4-naphthoquinone |
| PR-171 | 2-pyrrolidino-3-chloro-1,4-naphthoquinone |
| PR-172 | 2-diethylamino-3-chloro-1,4-naphthoquinone |
| PR-173 | 2-diethylamino-1,4-naphthoquinone |
| PR-174 | 2-piperidino-1,4-naphthoquinone |
| PR-175 | 2-pyrrolidino-1,4-naphthoquinone |
| PR-176 | 2-(2-hexyloxy)-1,4-naphthoquinone |
| PR-177 | 2-neo-pentyloxy-1,4-napthoquinone |
| PR-178 | 2-(2-n-pentyloxy)-1,4-naphthoquinone |
| PR-179 | 2-(3-methyl-n-butoxy)-1,4-naphthoquinone |
| PR-180 | 2-(6-hdyroxy-n-heroxy)-1,4-naphthoquinone |
| PR-181 | 2-ethoxy-3-chloro-1,4-naphthoquinone |
| PR-182 | 2-di(phenyl)methoxy-1,4-naphthoquinone |
| PR-183 | 2-(2-hydroxyethoxy)-3-chloro-1,4-napthoquinone |
| PR-184 | 2-methyl-3-(1-hydroxymethyl)ethyl-1,4-napthoquinone |
| PR-185 | 2-azetidino-3-chloro-1,4-naphthoquinone |
| PR-186 | 2-(2-hydroxyethyl)-3-bromo-1,4-naphthoquinone |
| PR-187 | 2,3-dimorpholino-1,4-naphthoquinone |
| PR-188 | 2-ethylamino-3-piperidino-1,4-naphthoquinone |
| PR-189 | 2-ethoxymethyl-1,4-naphthoquinone |
| PR-190 | 2-phenoxymethyl-1,4-naphthoquinone |

While each of the various categories of photoreductants noted above form a redox couple with cobalt(III) complexes upon exposure to actinic radiation in excess of 300 nanometers in wavelength, the photoreductants vary somewhat in the manner and mechanism through which they react. Many of the photoreductants react rapidly with the cobalt(III) complex upon exposure to actinic radiation. Certain of the quinone photoreductants exhibit this reaction characteristic. Other of the photoreductants form a redox couple upon exposure, but require an extended period to reduce the cobalt(III) complex. In most instances, it is desirable to heat the redox couple formed by the exposed photoreductant and cobalt(III) complex to drive the reaction to a more timely completion. Although optimum levels of heating vary considerably, depending upon specific choices of photoreductants, cobalt(III) complexes, other materials present and desired photographic speeds, typically, heating the redox couple in the temperature range of from 80° to 150° C. is preferred.

Photoreductant Adjuvants

The photoreductants employed in the practice of this invention shift the position of or change the number of atoms contained within the molecule in the course of conversion to the corresponding reducing agent. Internal hydrogen-source quinones are exemplary of photoreductants capable of relying entirely on the atoms initially present within the molecule to permit conversion to the corresponding reducing agent. In other photoreductants, conversion to the corresponding reducing agent may require that an adjuvant be present in intimate association with the photoreductant to donate the necessary atoms to permit formation of the reducing agent. For example, in quinones lacking an internal hydrogen source it is necessary to employ in combination an adjuvant capable of functioning as an external source of hydrogen atoms. In most instances we have observed significant improvements in performance by employing in combination with our photoreductants an adjuvant, such as an external hydrogen source, to facilitate conversion of the photoreductant to a reducing agent, whether or not the photoreductant itself contains the requisite atoms for its conversion to a reducing agent.

Any conventional source of labile hydrogen atoms that is not otherwise reactive with the remaining components or their reaction products contained within the photographic element can be utilized as an adjuvant. Generally preferred for use are organic compounds having a hydrogen atom attached to a carbon atom to which a substituent is also attached which greatly weakens the carbon-to-hydrogen bond, thereby rendering the hydrogen atom labile. Preferred hydrogen-source compounds are those which have a hydrogen atom bonded to a carbon atom to which is also bonded the oxygen atom of an oxy substituent and/or the trivalent nitrogen atom of an amine substituent. As employed herein, the term "amine substituent" is inclusive of amide and imine substituents. Exemplary preferred substituents which produce marked lability in a hydrogen atom associated with a common carbon atom are oxy substituents, such as hydroxy, alkoxy, aryloxy, alkaryloxy and aralkoxy substituents and amino substituents, such as alkylarylamino, diarylamino, amido, N,N-bis(1-cyanoalkyl)amino, N-aryl-N-(1-cyanoalkyl-)amino,N-alkyl-N-(1-cyanoalkyl)amino, N,N-bis(1-carbalkoxyalkyl)amino, N-aryl-N-(1-carbalkoxyalkyl-)amino, N-alkyl-N-(1-carbalkoxyalkyl)amino, N,-N-bis(1-nitroalkyl)amino, N-alkyl-N-(1-nitroalkyl)amino, N-aryl-N-(1-nitroalkyl)amino, N,N-bis(1-acylalkyl-)amino, N-alkyl-N-(1-acylalkyl)amino, N-aryl-N(1-acylalkyl)amino, and the like. The aryl substituents and substituent moieties are preferably phenyl or phenylene while the aliphatic hydrocarbon substituents and substituent moieties preferably incorporate twenty or fewer carbon atoms and, more preferably, six or fewer carbon atoms. Exemplary of compounds which can be used in the practice of this invention for the purpose of providing a ready source of labile hydrogen atoms are those set forth in Table V. Compounds known to be useful in providing labile hydrogen atoms are also disclosed in U.S. Pat. No. 3,383,212, issued May 14, 1968, the disclosure of which is here incorporated by reference.

TABLE V

| Exemplary External Hydrogen Source Compounds | |
|---|---|
| HS- 1 | poly(ethylene glycol) |
| HS- 2 | phenyl-1,2-ethanediol |
| HS- 3 | nitrilotriacetonitrile |
| HS- 4 | triethylnitrilotriacetate |
| HS- 5 | poly(ethylene glycol) |
| HS- 6 | poly(vinyl butyral) |
| HS- 7 | poly(vinyl acetal) |
| HS- 8 | 1,4-benzenedimethanol |
| HS- 9 | methyl cellulose |
| HS-10 | cellulose acetate butyrate |
| HS-11 | 2,2-bis-(hydroxymethyl)propionic acid |
| HS-12 | 1,3-bis-(hydroxymethyl)urea |
| HS-13 | 4-nitrobenzyl alcohol |
| HS-14 | 4-methoxybenzyl alcohol |

TABLE V-continued

| Exemplary External Hydrogen Source Compounds | |
|---|---|
| HS-15 | 2,4-dimethoxybenzyl alcohol |
| HS-16 | 3,4-dichlorophenylglycol |
| HS-17 | N-(hydroxymethyl)benzamide |
| HS-18 | N-(hydroxymethyl)phthalimide |
| HS-19 | 5-(hydroxymethyl)uracil hemihydrate |
| HS-20 | nitrilotriacetic acid |
| HS-21 | 2,2',2"-triethylnitrilotripropionate |
| HS-22 | 2,2',2"-nitrilotriacetophenone |
| HS-23 | poly(vinyl acetate) |
| HS-24 | poly(vinyl alcohol) |
| HS-25 | ethyl cellulose |
| HS-26 | carboxymethyl cellulose |
| HS-27 | poly(vinyl formal) |

The external hydrogen-source adjuvants incorporated within the photographic elements of the present invention can, in fact, perform more than one function. For example, the polymers included in Table V can also be used as binders as well as to provide a source of labile hydrogen atoms. These compounds are designated as external hydrogen-source compounds only to point up that the labile hydrogen atoms are not incorporated in the photoreductant.

Radiation-Sensitive Composition, Layer and Element

To form a radiation-sensitive composition useful in the present invention, it is merely necessary to bring together the photoreductant and the cobalt(III) complex. If required by the choice of photoreductant, an adjuvant should also be included. The radiation-sensitive composition can then be brought into a spacially fixed relationship, as by coating the composition onto a support to form a radiation-sensitive element according to the present invention. For maximum efficiency of performance it is preferred that the components of the radiation-sensitive composition, particularly, the photoreductant, the cobalt(III) complex and the adjuvant, if any, be intimately associated. This can be readily achieved, for example, by dissolving the reactants in a solvent system.

The solvent system can be a common solvent or a combination of miscible solvents which together bring all of the reactants into solution. Typical preferred solvents which can be used alone or in combination are lower alkanols, such as methanol, ethanol, isopropanol, t-butanol and the like; ketones, such as methylethyl ketone, acetone and the like; water; liquid hydrocarbons; chlorinated hydrocarbons, such as chloroform, ethylene chloride, carbon tetrachloride and the like; ethers, such as diethyl ether, tetrahydrofuran, and the like; acetonitrile; dimethyl sulfoxide and dimethyl formamide.

For ease of coating and for the purposes of imparting strength and resilience to the radiation-sensitive layer, it is generally preferred to disperse the reactants in a resinous polymer matrix or binder. A wide variety of natural and synthetic polymers can be used as binders. In order to be useful, it is only necessary that the binders be chemically compatible with the reactants. In addition to performing their function as a binder, the polymers can also serve as adjuvants such as external hydrogen sources to supplement or replace other adjuvants such as hydrogen sources as described above. For example, any of the polymers set forth in Table V can be used both as binders and as external hydrogen sources.

It is preferred to employ linear film-forming polymers such as, for example, gelatin, cellulose compounds, such as ethyl cellulose, butyl cellulose, cellulose acetate, cellulose triacetate, cellulose butyrate, cellulose acetate butyrate and the like; vinyl polymers, such as poly(vinyl acetate), poly(vinylidene chloride), a poly(vinyl acetal) such as poly(vinyl butyral), poly(vinyl chloride-co-vinyl acetate), polystyrene, and polymers of alkyl acrylates and methacrylates including copolymers incorporating acrylic or methacrylic acid; and polyesters, such as poly(ethylene glycol-co-isophthalic acid-co-terephthalic acid), poly(p-cyclohexane dicarboxylic acid-co-isophthalic acid-co-cyclohexylenebismethanol), poly(p-cyclohexanedicarboxylic acid-co-2,2,4,4-tetramethylcyclobutane-1,3-diol) and the like. The condensation product of epichlorohydrin and bisphenol is also a preferred useful binder. Generally, any binder known to have utility in photographic elements and, particularly, diazo photographic elements can be used in the practice of this invention. These binders are well-known to those skilled in the art, so no useful purpose would be served by including an extensive catalogue of representative binders in this specification. Any of the vehicles disclosed in *Product Licensing Index*, Vol. 92, December, 1971, publication 9232, at page 108, can be used as binders in the radiation-sensitive elements of this invention.

While the proportions of the reactants forming the radiation-sensitive layer can be varied widely, it is generally preferred for most efficient utilization of the reactants that they be present in roughly stoichiometric concentrations, that is, equal molar concentrations. One or more of the reactants can, of course, be present in excess. For example, where the external hydrogen source is also used as a binder, it is typically present in a much greater concentration than is essential merely for donation of labile hydrogen atoms. It is generally preferred to incorporate from 0.1 to 10 moles of the cobalt(III) complex per mole of the photoreductant. Adjuvants, such as external hydrogen sources, supplied solely to perform this function are typically conveniently incorporated in concentrations of from 0.5 to 10 moles per mole of photoreductant. The binder can account for up to 99% by weight of the radiation-sensitive layer, but is typically employed in proportions of from 50 to 90% by weight of the radiation-sensitive layer. It is, of course, recognized that the binder can be omitted entirely from the radiation-sensitive layer. The surface or areal densities of the reactants can vary, depending upon the specific application; however, it is generally preferred to incorporate the cobalt(III) complex in a concentration of at least $1\times10^{-7}$ moles per square decimeter and, most preferably, in a concentration of from $1\times10^{-5}$ to $1\times10^{-4}$ moles per square decimeter. The areal densities of the remaining reactants are, of course, proportionate. Typically, the radiation-sensitive layer can vary widely in thickness depending on the characteristics desired for the radiation-sensitive element, e.g., image density, flexibility, transparency, etc. For most photographic applications, coating thicknesses in the range of from 2 microns to 20 microns are preferred.

Any conventional photographic support can be used in the practice of this invention. Typical supports include transparent supports, such as film supports and glass supports as well as opaque supports, such as metal and photographic paper supports. The support can be either rigid or flexible. Preferred supports for most applications are paper or film supports. The support can incorporate one or more subbing layers for the purpose of altering its surface properties. Typically, subbing layers are employed to enhance the adherency of the radiation-sensitive coating to the support. Suitable exemplary supports are disclosed in *Product Licensing Index*, Vol. 92, December, 1971, publication 9232, at page 108.

The radiation-sensitive layer can be formed on the support using any conventional coating technique. Typically, the reactants, the binder (if employed) and any other desired addenda are dissolved in a solvent system and coated onto the support by such means as whirler coating, brushing doctor-blade coating, hopper coating and the like. Thereafter, the solvent is evaporated. Other exemplary coating procedures are set forth in the *Product Licensing Index* publication cited above, at page 109. Coating aids can be incorporated into the coating composition to facilitate coating, as disclosed on page 108 of the *Product Licensing Index* publication. It is also possible to incorporate antistatic layers and/or matting agents, as disclosed on this page of the *Product Licening Index* publication.

As is illustrated in FIG. 1, in a simple form the radiation-sensitive element 100 can be formed entirely of a support 102 and a radiation-sensitive layer 104. In this form the radiation-sensitive element need not exhibit an image-recording capability, rather the radiation-sensitive element merely exhibits a selective response to imagewise exposure with actinic radiation. The selective response can be usefully employed, as in recording the image in a separate photographic element. In a preferred radiation-sensitive element of this type, the cobalt(III) complex incorporates one or more ligands which can be volatilized upon reduction of the complex. For example, the cobalt(III) complex can incorporate one or more ammine ligands which are liberated as ammonia upon imagewise reduction of the cobalt(III) complex. For such an application it is preferred to choose a cobalt(III) complex which incorporates a large number of ammine ligands, as are present in cobalt hexa-ammine and cobalt penta-ammine complexes.

Separate Image-Recording Layers and Elments

Where the radiation-sensitive layers employed in the practive of this invention do not incorporate an image-recording capability, it is contemplated that a separate image-recording layer be used with the radiation-sensitive layer. In a simple form a separate image-recording element can be used in combination with a radiation-sensitive element, such as element 100. In this way reaction products released upon imagewise exposure of the radiation-sensitive element can be transferred in an image pattern to produce an image printout or bleachout in the image-recording layer. In one form of the invention, it is contemplated that ammonia will be imagewise-transferred from the radiation-sensitive layer to a separate image-recording element. In such instance, the image-recording element can take the form of any conventional element containing a layer capable of producing an image as a result of ammonia receipt or, more generally, contact with a base.

In a simple form, the image-recording element can consist of a support bearing thereon a coating including a material capable of either printout or bleachout upon contact with ammonia. For example, materials such as phthalaldehyde and ninhydrin print out upon contact with ammonia and are therefore useful in forming negative images. A number of dyes, such as certain types of cyanine dyes, styryl dyes, rhodamine dyes, azo dyes, etc., are known capable of being altered in color upon contact with a base. Particularly preferred for forming positive images are dyes which are bleached by contact with a base, such as ammonia, to a substantially transparent form. Pyrylium dyes have been found to be particularly suited for such applications. While the image-recording layer can consist essentially of a pH- or ammonia-responsive imaging material, in most instances it is desirable to include a binder for the imaging material. The image-recording element can be formed using the same support and binder materials employed in forming the radiation-sensitive element or in any other convenient, conventional manner.

To record an image using separate radiation-sensitive and image-recording elements, the radiation-sensitive layer of the radiation-sensitive element is first imagewise-exposed to radiation of from 300 to about 900 nm, preferably to radiation of from 300 to 700 nm. This can be accomplished using a mercury arc lamp, carbon arc lamp, photoflood lamp, laser or the like. Upon exposure to actinic radiation, the photoreductant present in the radiation-sensitive layer is converted to a reducing agent in exposed areas and forms a redox couple with the cobalt(III) complex. Where a redox couple is formed which reacts rapidly at ambient temperatures, it is desirable to have the image-recording layer of the image-recording element closely associated with the radiation-sensitive layer at the time of exposure. Where the redox couple reacts more slowly, as in those instances where it is desirable to drive the redox reaction to completion with the application of heat, the image-recording element can be associated with the radiation-sensitive element before or after exposure. For example, in one form the radiation-sensitive element can be exposed and thereafter associated with the image-recording element, as by feeding the elements with the radiation-sensitive and image-recording layers juxtaposed between heated rolls. After the radiation-sensitive element has been used to produce an image in the image-recording element, it can be discarded or, where a more slowly reacting redox couple is formed, reused with another image-recording element to provide another photographic print.

Where a cobalt(III) complex is employed which contains ammine ligans, it is contemplated that the ammonia given off upon reduction of the complex can, by proper choice of reactants, stimulate further imagewise release of ammine ligands. For example, $\mu$-superoxodecammine dicobalt(III) compounds can be decomposed by contact with free ammonia. Hence, when a radiation-sensitive layer is formed using this type of cobalt(III) complex, the photoreductant, which has been converted to a reducing agent by irradiation, initiates reduction of the complex, but thereafter the ammonia released can further reduce the $\mu$-superoxodecammine dicobalt(III) compound in irradiated areas.

In another form of this invention, a hydrogen amine (e.g., ammonia or a primary or secondary amine) can be employed in place of radiation to convert a quinone to a reducing agent for a cobalt(III) complex. For example, where a quinone is provided which is unsubstituted in at least one quinoid ring position adjacent a carbonyl group (e.g., 2 to 3 ring position in the case of 1,4-benzoquinones and 1,4-napthoquinones), a hydrogen amine such as ammonia can react with the quinone at the unsubstituted ring position to form the corresponding amino-1,4-hydroquinone. The hydroquinone then reduces the cobalt(III) complex. Where the cobalt(III) complex contains a releaseable hydrogen amine ligand, still more hydroquinone will be generated. The reaction can be initiated by any source of hydrogen amine. The quinone can function initially as a photoreductant or a separate photoreductant can be incorporated initially to reduce a hydrogen amine containing cobalt(III) complex and liberate the hydrogen amine. In another form, the hydrogen amine can be externally supplied. In still another form, the reduction of a cobalt(III) complex to liberate hydrogen amine can be directly stimulated with ultraviolet light or by sensitizing the cobalt(III) complex to visible light.

The practice of this invention employing separate radiation-sensitive and image-recording elements is illustrated by reference to the following examples:

EXAMPLES 1 through 20

An image-recording element was in each instance formed by adding a solution of 30 mg of dye, identified below in Table VI, in 0.50 grams of dimethylformamide to 5.0 grams of a 10 percent by weight solution of cellulose acetate butyrate in acetone. The resulting solution was coated at 43° C. on a poly(ethylene terephthalate) film support to a wet coating thicness of approximately 100 microns and dried.

A radiation-sensitive element was formed by solvent coating onto a poly(ethylene terephthalate) film support a composition 8.1 mg/dm$^2$ of 2-isopropoxy-1,4-naphthoquinone (PR-145), 6.2 mg/dm$^2$ of cobalt hexaammine acetate (C-1) and 60.3 mg/dm$^2$ of cellulose acetate butyrate (HS-10) in acetone.

The radiation-sensitive element was given a 20-second imagewise exposure with an ultraviolet-light source (commercially available as a Canon Kalfile Printer 340 VC). The exposed radiation-sensitive coating and the image-recording coating were placed face to face and passed through a pair of pressure rollers heated to 100° C. and having a linear speed of 0.66 cm/sec. After passing between the rollers, the radiation-sensitive and image-recording elements were separated and the image-recording layer viewed. The observed results are set forth below in Table VI.

TABLE VI

Exemplary Pyrylium Dye Containing Separate Image-Recording Elements

| Example No. | Dye | Unexposed Areas | Exposed Areas |
|---|---|---|---|
| 1 | 2,6-diphenyl-4-(3-methoxyphenyl) pyrylium perchlorate | yellow | colorless |
| 2 | 4-phenyl-2,6-dithienyl pyrylium perchlorate | orange-yellow | colorless |
| 3 | 4-(4-morpholinophenyl)-2,6-diphenyl-pyrylium perchlorate | magenta | colorless |
| 4 | 2,6-bis(p-methoxyphenyl)-4-phenyl-pyrylium fluoroborate | orange | colorless |
| 5 | 2,4-diphenyl-6-($\beta$-methyl-3,4-diethoxy- | magenta | colorless |

TABLE VI-continued

| Exemplary Pyrylium Dye Containing Separate Image-Recording Elements | | | |
|---|---|---|---|
| Example No. | Dye | Unexposed Areas | Exposed Areas |
| | styryl)pyrylium fluoroborate | | |
| 6 | 4-(4-dimethylaminovinyl)2,6-diphenyl-pyrylium perchlorate | cyan | colorless |
| 7 | 2-(2-naphthyl)-4,6-diphenylpyrylium perchlorate | orange-yellow | colorless |
| 8 | 9-(4-dimethylaminobenzylidene)-2,4-diphenyl-6,7,8,9-tetrahydro-5H-cyclo-hepta[b]pyrylium perchlorate | blue | pale yellow |
| 9 | 2,6-diphenyl-4-[2(10-methylpheno-thiazinyl)]pyrylium perchlorate | green | colorless |
| 10 | 2-butyl-3-[β-(2-hydroxy-1-naphthyl)-vinyl]-naphtho[2,1-b]pyrylium per-chlorate | blue | colorless |
| 11 | 4-(2-hydroxy benzylidene)-1,2,3,4-tetra-hydro xanthylium perchlorate | red | colorless |
| 12 | 2,4-diphenyl-6-(β-ethyl-p-methoxystyryl)-pyrylium fluoroborate | orange | colorless |
| 13 | 4-[4-(N-benzyl-N-ethylamino)-2-methyl-phenyl]-2,6-diphenylpyrylium perchlorate | violet | light tan |
| 14 | 4-(4-methylmercaptophenyl)2,6-diphenyl-pyrylium perchlorate | orange | colorless |
| 15 | 9-phenyldibenzo[a,j]xanthylium perchlor-ate | pink | colorless |
| 16 | 2,6-diphenyl-4-(4-methoxycarbonylphenyl)-pyrylium perchlorate | yellow | colorless |
| 17 | 4-(4-methylmercaptostyryl)-2,6-diphenyl-pyrylium perchlorate | red | pale yellow |
| 18 | 5,6-dihydro-2,4-diphenylnaphtho[1,2-b] pyrylium fluoroborate | yellow | colorless |
| 19 | 8-(benzo[b]-3H-1,2-dithiol-3-ylidene)-9,10,11,12-tetrahydro-8H-cyclohepta[e] naphtho[2,1-b]-pyrylium perchlorate | cyan | colorless |
| 20 | 4-(4-methoxystyryl)-2,6-diphenylpyrylium perchlorate | red | pale yellow |

EXAMPLE 21

The procedure of Examples 1 through 20 was repeated substituting 4-(4-diethylaminostyryl)quinoline monohydrochloride as the dye present. The unexposed area was red and the exposed area was bright yellow.

EXAMPLE 22

The procedure of Examples 1 through 20 was repeated substituting for the dye 30 mg of 3',6'-bis(N-methyl-N-phenylamino)fluoran and 13 mg of p-toluenesulfonic acid (to yield a rhodamine dye of the type disclosed in British Pat. No. 1,286,885). The unexposed area was dark violet and the exposed area was light violet.

EXAMPLE 23

A radiation-sensitive element was formed by coating a mixture of 0.2 gram of PR-145, 0.1 gram of C-1, 0.5 gram HS-10, 5.0 grams of 2-methoxyethanol and 5.0 grams of acetone to a wet coating thickness of approximately 100 microns on a poly(ethylene terephthalate) film support.

An image-recording element was formed by coating a mixture of 8.0 grams of 10 percent cellulose acetate butyrate in 80:20 weight ratio acetone/methyl alcohol solvent system, 0.25 g of o-phthalaldehyde and 1.75 grams acetone on a poly(ethylene terephthalate) film support to a wet coating thickness of approximately 100 microns.

After drying the radiation-sensitive coating was imagewise-exposed for 0.5 second using a 400-watt medium-pressure mercury arc lamp (commercially available as a Micro Master Diazo Copier) providing light primarily in the 300- to 500-nm wavelength range. The image-recording and exposed radiation-sensitive layers were then placed in face-to-face abutment and passed between a pair of rollers heated to 100° C. Upon separating the radiation-sensitive element, the image-recording element exhibited a neutral image having a density of 1.0 to 1.5. The image-recording element was substantially free of background printout and no printout in background areas was observed during subsequent handling of the image-recording element in room light.

EXAMPLE 24

A composition was prepared consisting essentially of 130 mg of 4-diethylaminobenzenediazonium tetrafluoroborate (PR-29), 1500 mg of C-3, 30.4 grams of 2-methoxyethanol; and 68.0 grams of 10% by weight solution of HS-10 in a 80:20 mixture of acetone and methyl alcohol. The composition was coated on a poly-(ethylene terephthalate ) film support to a wet coating thickness of 100 microns and allowed to dry. The dried coating was imagewise-exposed for 2 seconds using as a radiation source a medium-pressure mercury lamp providing radiation principally in the range of from 300 to 500 nanometers. The radiation-sensitive element was then placed in face-to-face relationship with an ammonia-bleachable image-recording element. The image-recording element was formed by coating a solution consisting essentially of 3.96 grams 2,4-diphenyl-6-(beta-methyl-3,4-diethoxystyryl)pyrylium tetrafluoroborate, 19.80 grams of cellulose acetate butyrate and 273.0 grams acetone to a wet coating thickness of 100 microns on a poly(ethylene terephthalate) film support. The two elements were passed between rolls heated to 130° C. in face-to-face relationship. The dye was bleached in areas corresponding to the radiation-exposed areas of the radiation-sensitive element to produce a positive magenta image.

EXAMPLES 25 THROUGH 32

The procedure of the preceding example was repeated, but with the substitution of various diazonium salts as photoreductants. The photoreductants and results are set forth below in Table VII. An exposure of 4 seconds was employed.

TABLE VII

| Example No. | Photoreductant | Image Quality |
|---|---|---|
| 25 | (PR-47) | weak |
| 26 | (PR-52) | good |
| 27 | (PR-53) | good |
| 28 | (PR-56) | weak |
| 29 | (PR-59) | moderately weak |
| 30 | (PR-62) | weak |
| 31 | (PR-65) | moderately weak |
| 32 | (PR-68) | moderately weak |

Figure 2:
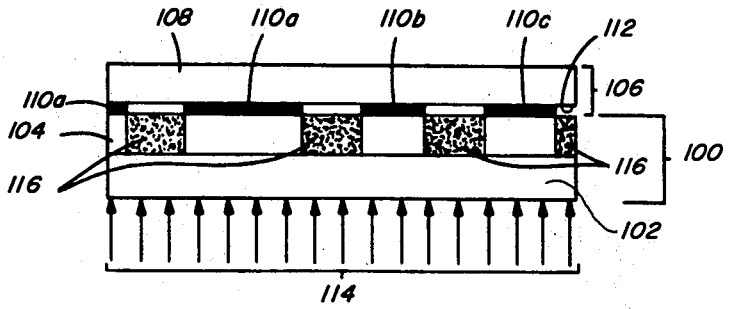
FIG. 2 is a schematic diagram of the radiation-sensitive element in combination with an original image-bearing element receiving a reflex exposure.
Figure 3:
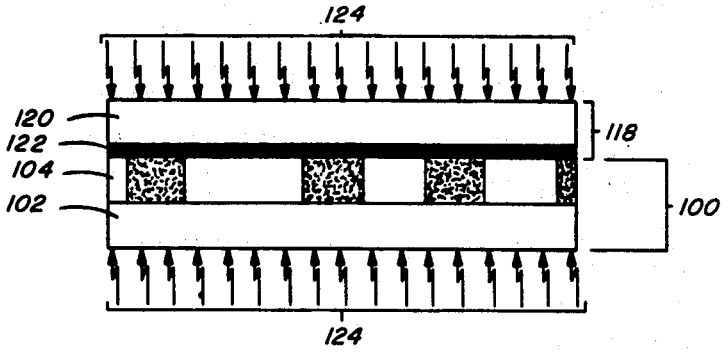
FIG. 3 is a schematic diagram of the radiation-sensitive element in combination with a copy sheet-receiving thermal processing.
Figure 4:
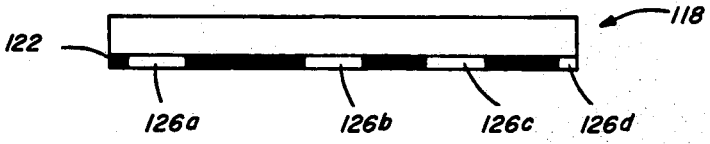
FIG. 4 is a schematic diagram of the imaged copy sheet.

A further illustrative practice of this invention employing separate radiation-sensitive and image-recording elements can be appreciated by reference to FIGS. 2 through 4 of the drawings. In FIG. 2 the radiation-sensitive element 100 comprised of support 102, which in this instance is a substantially transparent support, and radiation-sensitive layer 104 is placed in contact with an article 106 to be copied comprised of support 108 and coated image areas 110*a*, 110*b*, 110*c* and 110*d*. The support is formed to provide a reflective surface. For example, the support can be paper or can be formed with a reflective coating. The image areas are formed using a material which is substantially absorptive within the spectrum of exposure.

With the elements 100 and 106 associated as illustrated, the radiation-sensitive element is uniformly exposed to actinic radiation, indicated schematically by arrows 114, through the support 102. Substantially all of the radiation reaches and penetrates the radiation-sensitive layer 104. A significant portion of the radiation reaches the article to be copied and is either absorbed or reflected back into the radiation-sensitive layer, depending upon whether the radiation impinges upon the reflective surface 112 or the image areas. As a result of differential availability of actinic radiation to the radiation-sensitive layer, exposed zones 116 are formed in the radiation-sensitive layer in which a comparatively high concentration of redox couple is formed.

After exposure, the radiation-sensitive element is separated from the article to be copied and is brought into contact with an image-recording element comprised of a support 120 and an image-recording layer 122. In the form shown the image-recording is chosen to be initially colored, but capable of being bleached, although an initially colorless image-recording layer which is capable of being colored could be alternatively employed. Upon the uniform application of heat, as is schematically illustrated by the arrows 124, the redox couples formed in the exposed areas 116 of the radiation-sensitive layer are caused to react. The reaction product diffuses from the radiation-sensitive layer 104 to the adjacent image-recording layer 122 and causes the image-recording layer to become bleached in areas 126*a*, 126*b*, 126*c* and 126*d*. Thus, a positive copy of the article 106 is formed. By employing an initially colorless image-recording layer which is colored by receipt of reaction products from the radiation-sensitive layer, a negative copy of the article can be formed. It is thus apparent that either positive or negative copies can be formed by reflex-exposure techniques according to the practice of this invention. It is, of course, recognized that the practice of this invention is not limited to reflex-exposure techniques, although these are advantageous for many applications.

Reflex exposure is further illustrated by reference to the following example:

EXAMPLE 33

The following solution was prepared: Cobalt(III) hexa-ammine acetate (C-1) 115 mg, 2-morpholino-1,4-naphthoquinone (PR-165) 80 mg, cellulose acetate butyrate (HS-10) 1 g and acetone 10 ml.

The above solution was coated to 100 microns wet thickness on a poly(ethylene terephthalate) support. After drying, a black-on-white document was then placed face down onto the above coating. A reflex exposure was carried out by exposing through the support of the photosensitive intermediate to a 650-watt incandescent lamp (commercially available as a Nashua 120 Multi Spectrum Copier) for 3 seconds. The document was removed and the exposed intermediate was heated in contact with an ammonia-sensitive receiver sheet at 100°–110° C. for 10 seconds by passing the composite through a pair of heated rolls. The receiver sheet was coated with an acidified solution of 3,3'-dimethylene-2,2'-spirobi[(2H)naphtho[2,1,6]pyran] in HS-10. A blue-on-white positive copy of the black-on-white document was obtained. When a conventional diazo recording element (commercially available under the trade name RECORDAK Diazo-M) was used as a receiver sheet, a negative copy of the document was obtained.

Separate Photoreductant Layers and Cobalt(III) Complexes

In addition to the separation of the image-recording element from the radiation-sensitive element, it is also possible for the photoreductant to be separated from the cobalt(III) complex prior to exposure. For example, the photoreductant can be applied, with or without a binder, to a suitable support, and after drying such element it can be imagewise-exposed and thereafter treated by a solution of the cobalt(III) complex and simultaneously or subsequently treated with an image-generating solution or compound, such as a chelating compound which will chelate with cobalt(II) produced by the reduction of the complex in response to reducing agent formed by the exposure of the photoreductant. Typical compounds suitable for such chelation appear in Table X infra. Treating the element with the solution of the complex and/or the chelating compound can be by spraying, for example. Subsequent processing, such as by heating, suffices to bring up the image.

Alternatively, it is contemplated that the cobalt(III) complex can be coated as a layer on a support for a separate element, and thereafter be brought into contact with an element comprising an imagewise-exposed photoreductant applied to its own support, the two layers being heated, for example, in the presence of a solution bearing an image-generating agent, such as a cobalt(II)

chelating compound, discussed in the preceding paragraph.

The practice of the invention in which the photoreductant is separated from the cobalt(II) complex is illustrated by reference to the following Examples 34–41. In each of these, the photoreductant was coated on filter paper by dipping the filter paper into a solution prepared by dissolving 0.1 g of the photoreductant in 10 ml of acetone or methanol, after which the paper was dried. Such element in each case was exposed through a silver original to the light source of the Micro Master Diazo Copier for 8 seconds. The exposed element was then sprayed with an Imaging Reagent prepared from the following components, whereupon it was heated at 120° C. on a hot block to develop the image.

| Imaging Reagent | Type I | Type II |
|---|---|---|
| hexa-ammine cobalt(III)acetate . $3H_2O$ | 1.0 g | — |
| hexa-ammine cobalt(III)trifluoroacetate | — | 1.0 g |
| 1-(2-pyridylazo)-2-naphthol | 0.1 g | — |
| thiourea | — | 2.0 g |
| acetone | 25 cc | 50 cc |
| methanol | 25 cc | — |
| water | 5 cc | — |

EXAMPLE 34

Phenanthrenequinone, the photoreductant, and Imaging Reagent Type II produced a black-on-yellow negative image when processed as described above.

EXAMPLE 35

2-Isopropoxy-1,4-naphthoquinone produced, with Imaging Reagent Type I, a red-on-yellow negative image.

EXAMPLE 36

α-Naphthyl 1'-phenethyl disulfide produced, with Imaging Reagent Type I, a red-on-yellow negative image.

EXAMPLE 37 p-Diethylaminobenzenediazonium tetrafluoroborate produced, with Imaging Reagent Type II, a black-on-yellow negative image.

EXAMPLE 38

9-Diazo-10-phenanthrone produced, with Imaging Reagent Type I, a red-on-yellow negative image.

EXAMPLE 39

4-Morpholinophenyl azide produced, with Imaging Reagent Type II, a black-on-white negative image.

EXAMPLE 40

2-Carbazido-1-naphthol produced, with Imaging Reagent Type II, a black-on-white negative image.

EXAMPLE 41

Potassium 4-(N-ethyl-N-hydroxyethylamino)-1-benzenediazolsulfonate produced, with Imaging Reagent Type II, a black-on-yellow negative image.

In the foregoing Examples 34–41, the red images were due to the complexation between the Co(II) and 1-(2-pyridylazo)-2-naphthol and the black images were due to the formation of cobalt sulfide from the Co(II) and thiourea.

Combined Radiation-Sensitive and Image-Recording Layers

Instead of employing separate radiation-sensitive and image-recording elements, separate, radiation-sensitive and image-recording layers can be incorporated within a single element. This can be illustrated by reference to FIG. 5. An element 200 is schematically shown comprised of a support 202 and a radiation-sensitive layer 204, which can be identical to support 102 and radiation-sensitive layer 104, described above. Overlying the radiation-sensitive layer is a separation layer 206. An image-recording layer 208, which can be identical to the separate image-recording layers previously discussed, overlies the separation layer. If desired, the relationship of the image-recording and radiation-sensitive layers can be interchanged.

The separation layer is an optional component of the element 200 because, in most instances, the image-recording and radiation-sensitive layers are chemically compatible for substantial time periods. However, to minimize any degradation of properties of either of the active layers due to migration of chemical components from one layer to the other, as could conceivably occur during extended periods of storage before use, it is preferred to incorporate the separation layer.

The separation layer is chosen to be readily permeable by the reaction product(s) to be released from the radiation-sensitive layer upon exposure while impeding unwanted migration of initially present components of the radiation-sensitive and image-recording layers. For example, the separation layer can be chosen to be readily permeable to ammonia, but relatively impermeable to liquid components. It has been found that a wide range of polymeric layers will permit diffusion of gaseous ammonia from the radiation-sensitive layer to the image-recording layer while otherwise inhibiting interaction of the components of these layers. It is generally preferred to employ hydrophobic polymer layers as separation layers where the radiation-sensitive and image-recording layers incorporate polar reactants whose migration is thought to be inhibited. Most preferred are linear hydrocarbon polymers, such as polyethylene, polypropylene, polystyrene and the like. It is generally preferred that the separation layer exhibit a thickness of less than about 200 microns in order to allow image definition to be retained in the image-recording layer. For most applications, separation layers of 20 or fewer microns are preferred.

Photoresponsive Separate Image-Recording Layers and Elements

Figure 5:
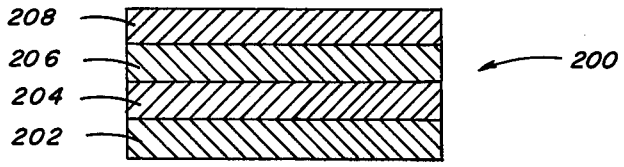
FIG. 5 is a schematic diagram of a composite radiation-sensitive imaging element.

While the separate image-recording layers heretofore described need not themselves be radiation-responsive, image-recording layers which are responsive both to reaction products released by the radiation-sensitive layers and also directly responsive to actinic radiation are recognized to be useful in the practice of this invention. For example, a conventional diazo recording element can be used as an image-recording element in the practice of this invention. Typically diazo recording elements are first imagewise-exposed to ultraviolet light to inactivate radiation-struck areas and then uniformly contacted with ammonia to print out a positive image. Diazo recording elements can initially incorporate both a diazonium salt and an ammonia-activated coupler (commonly referred to as two-component diazo systems) or can initially incorporate only the diazonium salt and rely upon subsequent processing to imbibe the coupler (commonly referred to as one-component diazo systems). Both one-component and two-component diazo systems can be employed in the practice of this invention. Subsequent discussions, although directed to the more common two-component diazo systems, should be recognized to be applicable to both systems. The photoresponsive image-recording layers can be incorporated in separate image-recording elements or can be incorporated directly within the radiation-sensitive elements of this invention, such as illustrated in FIG. 5.

The use of a radiation-sensitive layer and a separate photoresponsive image-recording layer in combination offers a versatility in imaging capabilities useful in forming either positive or negative images. The production of a positive image with such a combination can be readily appreciated by reference to FIG. 6. In this figure a radiation-sensitive layer 302 and a photoresponsive image-recording layer 304, such as a conventional diazo recording layer, are associated in face-to-face relationship. The layers, together with a support and separation layer, can, if desired, form a single element, such as element 200, or, in the alternative, the separate layers can be provided by placing a conventional diazo recording element and the radiation-sensitive element 100 in face-to-face relationship. As employed herein the term "face-to-face relationship" means simply that the image-recording and radiation-sensitive layers are adjacent and not separated by a support, as would occur in a back-to-back relationship.

To form a positive image, the photosensitive image-recording layer 304 is first imagewise-exposed to ultraviolet radiation, as is schematically indicated by transparency 306 bearing the image 308. This photolytically destroys the diazonium salt in the exposed areas of the image-recording layer. The radiation-sensitive layer 302 is preferably uniformly exposed to actinic radiation before it is associated with the layer 304, where separate image-recording and radiation-sensitive elements are employed. Alternately, where a single element is employed incorporating layers 302 and 304, the radiation-sensitive layer is uniformly exposed using radiation in the visible spectrum so as not to destroy the diazonium salt in image areas. Exposures through either major outer surface are contemplated where the layers 302 and 304 form a single element. Transparent or opaque supports can be used with either single- or plural-element arrangements. Heating of the layers 302 and 304 in face-to-face relationship results in ammonia's being released from the radiation-sensitive layer for migration to the diazo layer, thereby activating the coupler in the diazo layer to produce a dye image 310, which is a positive copy of the image 308. If an element bearing a negative image is substituted for transparency 306, the negative image will be reproduced in the layer 304.

Figure 6:
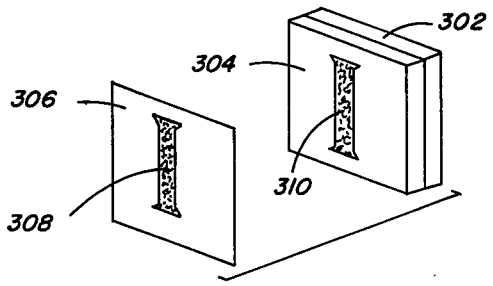
FIGS. 6 and 7 are schematic diagrams of an original image-bearing element and an image-bearing radiation-sensitive composite.
Figure 7:
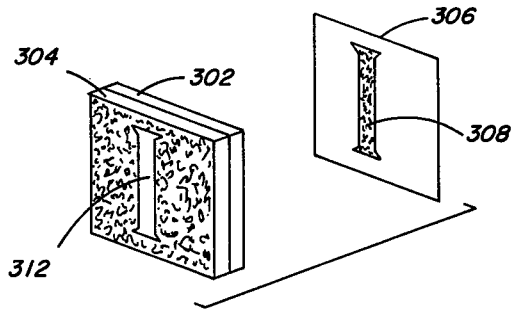

The identical photosensitive image-recording and separate radiation-sensitive layer combination employed to form a positive image in FIG. 6 can also be used to form a negative image, as illustrated in FIG. 7. To form a negative image the radiation-sensitive layer is first imagewise-exposed, as indicated by the transparency 306 bearing the image 308. Where the layers 302 and 304 are in separate elements, the radiation-sensitive element is preferably exposed before association with the image-recording element. Where the layers are in a single element, the radiation-sensitive layer is preferably exposed with visible radiation to avoid deactivating the diazo layer. With the layers associated as shown, they are uniformly heated. This imagewise-releases ammonia from the radiation-sensitive layer which migrates to the diazo layer, causing imagewise printout. The area of the diazo layer defining the negative image 312 can then be deactivated by exposure to ultraviolet light, if desired, although this is not required. The image 312 is a negative copy of the image 308. If an element bearing a negative image is substituted for transparency 306, the image will be reversed in the layer 304.

Numerous variations are contemplated and will be readily apparent to those skilled in the art. For example, the photoreductant and photoresponsive image-recording layer can be variously chosen to be responsive to other portions of the spectrum. Instead of the photoreductant's being responsive to visible light and the diazo layer's being responsive to ultraviolet light, as noted above, a diazonium salt can be chosen which is selectively responsive to visible light and a photoreductant chosen that is selectively responsive to either visible or ultraviolet light. Where both the radiation-sensitive and photoresponsive image-recording layers are present in a single element and are responsive to the same portion of the spectrum, it is necessary to provide a transparent support and it is desirable to include a separation layer that is substantially opaque to that portion of the spectrum. It is also contemplated that for certain applications the separation layer can advantageously be formed of or include an ultraviolet-absorbing material. In still another variation, where uniform ammonia release is employed to develop the diazo image, a supplementary base treatment can be used to enhance the diazo image, if desired.

The practice of this invention employing a photoresponsive image-recording layer and a separate radiation-sensitive layer in combination is further illustrated by the following examples:

EXAMPLES 42 THROUGH 161

In each instance, a coating composition was prepared consisting essentially of 1.0 gram of cellulose acetate butyrate (HS-10), 11.3 grams ethylene dichloride; 2.0 grams methanol, 2 drops of water, 0.10 gram hexaammine cobalt(III) acetate (C-1) and 1.00 millimole of a photoreductant. Each coating composition was used to prepare two identical coatings on poly(ethylene terephthalate) film support, each having a wet coating thickness of approximately 100 microns. Where it was desired to expose a coating to an additional light source, an additional, identical pair of radiation-sensitive elements was prepared.

Exposure was undertaken using either a predominantly ultraviolet and blue light source or a predominantly visible light source. The ultraviolet and blue light source employed a 400-watt medium-pressure mercury arc lamp. A 2-second exposure was given with this light source. This light source is commercially available under the trade name Micro Master Diazo Copier. The predominantly visible light source employed in incandescent lamp of 650 watts, and a 16-second exposure was given using this light source. This light source is commercially available under the trade name Nashua 120 Multi-Spectrum Copier. In each instance, exposure was made through a 0.3 log E silver step tablet. Approximately 10 seconds after exposure, the radiation-sensitive element was placed in face-to-face relationship with a diazo recording element commercially available unde the trademark RECORDAK Diazo M Film. To produce a negative image in the diazo-recording element, the face-to-face elements were passed three times between rollers heated to 100° C. at a linear rate of 0.66 cm/sec.

The speed of the radiation-sensitive elements was calculated as the quotient of 100 divided by the time in seconds required to reach neutral image density above gross fog of 0.40. For purposes-of comparison, these elements exhibiting speeds below 12.5 were considered to be slow, those exhibiting speeds of from 12.5 to 50 were categorized as moderately slow, those exhibiting speeds of from 50 to 100 were considered moderately fast, and those exhibiting speeds above 100 were categorized as being fast. The averaged results with each identically prepared and exposed pair of radiation-sensitive elements are reported below in Table VIII.

TABLE VIII

| Exemplary Photoresponse with Varied Photoreductants | | | | | |
|---|---|---|---|---|---|
| Example No. | Photo-reductant | Speed Near UV | Speed Visible | Neutral Minimum Density | Notes |
| 42 | PR-2 | Slow | N.A. | N.R. | (1) |
| 43 | PR-7 | Slow | N.A. | N.R. | (1) |
| 44 | PR-17 | Mod.Fast | N.A. | N.R. | — |
| 45 | PR-22 | Slow | N.A. | N.R. | (1) |
| 46 | PR-26 | Slow | N.A. | N.R. | (1) |
| 47 | PR-28 | Slow | N.A. | N.R. | (1) |
| 48 | PR-78 | Slow | N.A. | 0.08 | — |
| 49 | PR-78 | Slow | N.A. | 0.10 | (1) |
| 50 | PR-79 | Mod.Slow | N.A. | 0.09 | — |
| 51 | PR-79 | Mod.Slow | N.A. | 0.13 | (1) |
| 52 | PR-80 | Slow | N.A. | 0.11 | (1) |
| 53 | PR-81 | Mod.Slow | N.A. | 0.08 | — |
| 54 | PR-82 | Mod.Slow | N.A. | 0.10 | (3) |
| 55 | PR-82 | Mod.Fast | N.A. | 0.21 | (1) |
| 56 | PR-83 | Mod.Slow | N.A. | 0.10 | — |
| 57 | PR-83 | Mod.Slow | N.A. | 0.16 | (1) |
| 58 | PR-84 | Mod.Slow | N.A. | 0.08 | — |
| 59 | PR-85 | Mod.Slow | N.A. | N.R. | — |
| 60 | PR-86 | Mod.Slow | N.A. | 0.08 | — |
| 61 | PR-86 | Fast | N.A. | 0.25 | (1) |
| 62 | PR-87 | Slow | N.A. | 0.08 | — |
| 63 | PR-87 | Mod.Fast | N.A. | 0.10 | (1) |
| 64 | PR-88 | Slow | N.A. | 0.12 | (1) |
| 65 | PR-89 | Mod.Slow | N.A. | N.R. | (2) |
| 66 | PR-90 | Mod.Slow | N.A. | N.R. | (2) |
| 67 | PR-91 | Mod.Fast | N.A. | 0.10 | — |
| 68 | PR-92 | Mod.Slow | N.A. | 0.07 | — |
| 69 | PR-93 | Fast | N.A. | N.R. | (1) |
| 70 | PR-94 | Mod.Slow | N.A. | N.R. | (1) |
| 71 | PR-95 | Mod.Slow | N.A. | N.R. | (1) |
| 72 | PR-96 | Mod.Slow | N.A. | N.R. | (1) |
| 73 | PR-98 | Mod.Slow | N.A. | 0.07 | — |
| 74 | PR-99 | Mod.Slow | N.A. | 0.09 | (2) |
| 75 | PR-99 | N.A. | SLow | 0.09 | — |
| 76 | PR-100 | Mod.Slow | N.A. | 0.15 | — |
| 77 | PR-100 | N.A. | Slow | 0.15 | — |
| 78 | PR-101 | Mod.Slow | N.A. | 0.08 | (2) |
| 79 | PR-102 | Fast | N.A. | 0.08 | — |
| 80 | PR-105 | Fast | N.A. | 0.08 | — |
| 81 | PR-106 | Fast | N.A. | 0.08 | — |
| 82 | PR-107 | Fast | N.A. | 0.09 | — |
| 83 | PR-111 | Mod.Fast | N.A. | 0.08 | — |
| 84 | PR-115 | Mod.Slow | N.A. | 0.15 | (2) |
| 85 | PR-116 | Mod.Slow | N.A. | 0.20 | — |
| 86 | PR-117 | Mod.Slow | N.A. | N.R. | (2) |
| 87 | PR-118 | Mod.Slow | N.A. | 0.09 | — |
| 88 | PR-119 | Mod.Slow | N.A. | 0.10 | — |
| 89 | PR-120 | Mod.Slow | N.A. | 0.10 | — |
| 90 | PR-121 | Mod.Slow | N.A. | 0.10 | — |
| 91 | PR-122 | Mod.Slow | N.A. | 0.08 | — |
| 92 | PR-123 | Mod.Slow | N.A. | 0.09 | — |
| 93 | PR-124 | Mod.Slow | N.A. | 0.09 | — |
| 94 | PR-125 | Mod.Slow | N.A. | 0.06 | — |
| 95 | PR-126 | Fast | N.A. | 0.10 | — |
| 96 | PR-127 | Fast | N.A. | 0.09 | — |
| 97 | PR-128 | Mod.Fast | N.A. | 0.07 | — |

TABLE VIII-continued

| Exemplary Photoresponse with Varied Photoreductants | | | | | |
|---|---|---|---|---|---|
| Example No. | Photo-reductant | Speed Near UV | Speed Visible | Neutral Minimum Density | Notes |
| 98 | PR-130 | Fast | N.A. | 0.08 | — |
| 99 | PR-131 | Fast | N.A. | 0.07 | — |
| 100 | PR-132 | Mod.Slow | N.A. | 0.08 | — |
| 101 | PR-133 | Mod.Fast | N.A. | 0.06 | (4) |
| 102 | PR-135 | Fast | N.A. | 0.08 | — |
| 103 | PR-136 | Fast | N.A. | 0.10 | — |
| 104 | PR-137 | Fast | N.A. | 0.08 | — |
| 105 | PR-138 | Fast | N.A. | N.R. | — |
| 106 | PR-139 | Fast | N.A. | 0.09 | — |
| 107 | PR-140 | Fast | N.A. | 0.08 | — |
| 108 | PR-141 | Fast | N.A. | 0.08 | — |
| 109 | PR-142 | Fast | N.A. | N.R. | — |
| 110 | PR-143 | Fast | N.A. | 0.09 | — |
| 111 | PR-144 | Fast | N.A. | N.R. | (2) |
| 112 | PR-145 | N.A. | Slow | 0.08 | — |
| 113 | PR-146 | Fast | N.A. | 0.08 | — |
| 114 | PR-147 | Fast | N.A. | 0.11 | — |
| 115 | PR-148 | Fast | N.A. | 0.10 | — |
| 116 | PR-149 | Fast | N.A. | 0.09 | — |
| 117 | PR-150 | Fast | N.A. | 0.08 | — |
| 118 | PR-151 | Fast | N.A. | 0.08 | — |
| 119 | PR-152 | Mod.Slow | N.A. | 0.09 | — |
| 120 | PR-153 | Mod.Slow | N.A. | 0.10 | — |
| 121 | PR-154 | Mod.Slow | N.A. | 0.07 | — |
| 122 | PR-155 | Mod.Fast | N.A. | 0.10 | — |
| 123 | PR-156 | Mod.Slow | N.A. | 0.14 | — |
| 124 | PR-157 | Fast | N.A. | 0.10 | — |
| 125 | PR-158 | Fast | N.A. | 0.09 | — |
| 126 | PR-159 | Fast | N.A. | N.R. | (2) |
| 127 | PR-160 | Fast | N.A. | 0.08 | — |
| 128 | PR-161 | Mod.Slow | N.A. | 0.09 | — |
| 129 | PR-162 | Fast | N.A. | 0.08 | — |
| 130 | PR-163 | Mod.Slow | N.A. | 0.08 | — |
| 131 | PR-164 | N.A. | Slow | 0.11 | — |
| 132 | PR-165 | N.A. | Slow | 0.08 | — |
| 133 | PR-166 | N.A. | Slow | 0.08 | — |
| 134 | PR-167 | Mod.Slow | N.A. | 0.09 | — |
| 135 | PR-167 | N.A. | Slow | 0.09 | — |
| 136 | PR-168 | Mod.Slow | N.A. | 0.09 | — |
| 137 | PR-169 | N.A. | Mod.Slow | 0.08 | — |
| 138 | PR-170 | N.A. | Slow | 0.08 | — |
| 139 | PR-171 | N.A. | Slow | 0.10 | — |
| 140 | PR-172 | Fast | N.A. | 0.13 | — |
| 141 | PR-173 | N.A. | Mod.Slow | 0.09 | — |
| 142 | PR-173 | N.A. | Mod.Slow | 0.09 | — |
| 143 | PR-174 | N.A. | Slow | 0.08 | — |
| 144 | PR-175 | N.A. | Slow | 0.08 | — |
| 145 | PR-176 | Fast | N.A. | 0.08 | — |
| 146 | PR-177 | Fast | N.A. | 0.07 | — |
| 147 | PR-178 | Fast | N.A. | 0.08 | — |
| 148 | PR-179 | Fast | N.A. | 0.08 | — |
| 149 | PR-180 | Fast | N.A. | 0.09 | — |
| 150 | PR-181 | Fast | N.A. | 0.08 | — |
| 151 | PR-182 | Mod.Fast | N.A. | 0.09 | — |
| 152 | PR-183 | Mod.Fast | N.A. | 0.08 | — |
| 153 | PR-184 | Mod.Slow | N.A. | 0.10 | — |
| 154 | PR-185 | Mod.Slow | N.A. | 0.13 | — |
| 155 | PR-186 | Fast | N.A. | 0.11 | — |
| 156 | PR-187 | Mod.Slow | N.A. | 0.11 | — |
| 157 | PR-187 | N.A. | Slow | 0.11 | — |
| 158 | PR-188 | Mod.Fast | N.A. | 0.12 | — |
| 159 | PR-188 | N.A. | Slow | 0.12 | — |
| 160 | PR-189 | Mod.Fast | N.A. | 0.08 | — |
| 161 | PR-190 | Mod.Slow | N.A. | 0.08 | — |
| Control | None | No Image | N.A. | 0.06 | (5) |
| Control | None | N.A. | No Image | 0.06 | 85) |

N.A. = Not Applicable
N.R. = No data recorded that could be located for inclusion
(1) One equivalent of phenyl-1,2-ethanediol (HS-2) included as a hydrogen source.
(2) One pass was made through the heated rollers instead of three.
(3) 8 second exposure instead of 16-second exposure.
(4) Photoreductant incompletely dissolved in solvent; only decantate was used to form coatings.
(5) Procedure for preparing and evaluating control was identical to the preceding examples, except that no photoreductant was included in the coating composition.

EXAMPLE 162

Example 42 was repeated, but with the use of photoreductant PR-27, a 4-second exposure to the ultraviolet and blue light source, and a 2-pass development at 130° C. A diazo print was produced having a "slow" rating as defined in Example 42.

EXAMPLES 163 AND 164

Example 156 was repeated, but with the substitution of photoreductants PR-9 and 24, respectively. Similar results were obtained in each instance.

EXAMPLE 165

A radiation-sensitive element was prepared as described in Example 23. The radiation-sensitive element was placed in face-to-face relationship with a diazo recording element having a transparent base (commercially available under the trademark KODAK Diazo Type M Film). The exposure-and-development procedure of Example 23 was repeated, resulting in a reversed copy of the original image. The diazo recording layer was then fixed against further printout by uniform exposure to ultraviolet light.

EXAMPLE 166

A radiation-sensitive element and diazo recording element identical to those of the preceding example were mounted in face-to-face relationship. The combined elements were first imagewise-exposed through the diazo recording element for 2 seconds using the exposure unit of Example 23. Thereafter, the combined elements were flash-exposed for 0.5 second through the radiation-sensitive element using the same exposure unit and developed as in Example 23. An image was formed in the diazo recording element which was a positive of the image copied.

EXAMPLES 167 THROUGH 170

A composition was prepared consisting essentially of 130 mg of PR-29, 1500 mg of C-3, 30.4 grams of 2-methoxyethanol and 68.0 grams of 10% by weight solution of HS-10 in a 80:20 mixture of acetone and methyl alcohol. The composition was coated on a poly(ethylene terephthalate) film support to a wet coating thickness of 100 microns and allowed to dry. The dried coating was imagewise-exposed for 8 seconds using as a radiation source a medium-pressure mercury lamp providing radiation principally in the range of from 300 to 500 nanometers. The radiation-sensitive element was then placed in face-to-face relationship with a diazo recording element having a transparent base (commercially available under the trademark KODAK Diazo Type M Film), and the two elements so related were passed between rolls heated to 130° C. A negative of the original image was formed in the image-recording element which was fixed by subsequent exposure of the image-recording element to room light.

The procedure of the preceding example was repeated, but with the substitution of various diazonium salts as photoreductants. The photoreductants and results are set forth below in Table IX.

TABLE IX

| Example No. | Photoreductant | Image Quality |
|---|---|---|
| 167 | PR-29 | good |
| 168 | PR-32 | weak |

TABLE IX-continued

| Example No. | Photoreductant | Image Quality |
|---|---|---|
| 169 | PR-35 | good |
| 170 | PR-41 | good |

EXAMPLE 171

A coating composition was prepared by dissolving 0.2 gram of C-1 in 9 grams of 10% by weight poly(vinyl alcohol) in water. To this was added a solution of 0.2 gram of PR-160 in 1 gram of n-propanol. The composition was coated to a wet thickness of approximately 100 microns on a poly(ethylene terephthalate) film support. The dried coating was imagewise-exposed to an ultraviolet- and blue-radiation source, medium pressure mercury arc lamp for 8 seconds. This light source is commercially available under the trademark Micro Master Diazo Copier. The radiation-sensitive element was placed in face-to-face relationship with a diazo recording element having a transparent base (commercially available under the trademark KODAK Diazo Type M Film). The radiation-sensitive element and the image-recording element in face-to-face abutment were then passed between a pair of rollers heated to 100° C. at a linear rate of advance of 0.68 centimeter/sec. A negative diazo image was formed.

EXAMPLES 172 THROUGH 173

The procedure of the preceding example was repeated in each instance with C-6, C-13, and C-16 substituted for C-1. In each instance, a negative diazo image was obtained in the image-recording element.

EXAMPLE 174

Following the procedure of Example 171, except as otherwise stated, two coatings were prepared. Both coatings differed from the radiation-sensitive coating of Example 166 in substituting 0.115 gram of C-5 for the 0.2 gram of C-1. One of the coatings further differed from the coating of Example 171 through the omission of the photoreductant. The coating lacking a photoreductant produced no image even though it was exposed for 32 seconds. The remaining coating produced a negative image in the diazo recording element having a neutral density of 0.7.

EXAMPLE 175

Following the procedure of Example 171, except as otherwise stated, 0.2 gram of C-20 was substituted for C-1. The coating lacking a photoreductant produced no image in the diazo recording element, while the coating containing PR-160 produced a negative image in the diazo recording element having a neutral density of 0.7.

EXAMPLE 176

Following the procedure of Example 171, except as otherwise stated, 0.37 gram of C-16 was substituted for 0.2 gram of C-1. After exposure of 4 seconds, a negative image was obtained in the diazo recording element having a neutral density of 0.45.

EXAMPLE 177

Following the procedure of Example 171, except as otherwise stated, 0.2 gram of C-31 was substituted for C-1. After an exposure of 2 seconds, a negative image was obtained in the diazo recording element having a neutral density of 1.0.

EXAMPLE 178

An element 200 was formed using 100-micron poly-(ethylene terephthalate) to form the support 202. A radiation-sensitive layer 204 having a wet coating thickness of approximately 75 microns was formed on the support, using a coating composition consisting essentially of 0.2 gram PR-145; 0.1 gram C-1; 0.5 gram HS-10; 5.0 grams 2-methoxy ethanol and 5.0 grams acetone. After drying, a separation layer 206 was formed on the photosensitive image-recording layer, usng as a coating composition 10.0 grams of toluene and 0.5 gram styrene-butadiene copolymer. The separation exhibited a wet coating thickness of approximately 50 microns. Again, after drying, a photosensitive image-recording layer 208 was formed on the support to a wet coating thickness of approximately 100 microns from a composition consisting of 0.02 gram 5-sulphosalicylic acid, 0.066 gram p-(diethylamino)benzenediazonium tetrafluoroborate, 0.084 gram naphthol AS-D coupler (commercially available from GAF Corporation) and 0.8 gram cellulose acetate butyrate.

A positive image was made by imagewise-exposing the element from the diazo side for 7 seconds using a high-pressure mercury vapor light source commercially available under the trademark 3M Filmsort Uniprinter Copier. The element was then given a 3-second uniform exposure with the same light source through the support. The element was then heated for 5 seconds, support down, on a heat block maintained at 115° C. A positive image was obtained. The element exhibited a maximum neutral image density of 1.1 and a neutral background density of 0.07.

EXAMPLE 179

The preceding example was repeated, except that a negative image was formed by first imagewise-exposing for 3 seconds through the support, followed by heating. The residual diazonium salt was destroyed with an overall exposure of 7 seconds from the diazo layer side. Background and image densities were identical to those of the preceding example.

RADIATION-SENSITIVE LAYERS WITH IMAGE-RECORDING CAPABILITIES

In employing a radiation-sensitive layer to perform also the function of image recording, a radiation-sensitive element, such as element 100, can be employed having a radiation-sensitive layer containing only a cobalt(III) complex and a photoreductant as active components. To record images with a radiation-sensitive element of this type, the cobalt(III) complex is employed as an oxidant for a leuco dye which is convertible to a colored form upon oxidation. Alternatively, conventional dye-forming components (e.g., an oxidizable organic color developer and a coupler) can be employed which are converted to a colored dye upon oxidation of the organic color developer and coupling. In this approach, the radiation-sensitive layer is initially imagewise-exposed to form a redox couple in radiation-struck areas and thereafter heated to insure that the cobalt(III) complex is reduced to a cobalt(II) compound in these areas. Thereafter, the radiation-sensitive layer is brought into contact with a leuco dye or the dye-forming components are brought together within the radiation-sensitive layer. The cobalt(III) complex remaining in the nonirradiated areas then oxidates the leuco dye or the organic color developer so that a colored image is formed in the nonirradiated areas of the radiation-sensitive layer. The organic color developer and coupler therefor can be introduced into the radiation-sensitive layer together or separately. As is well-understood in the art, both the coupler and the oxidizable organic color developer can be contained in the developer solution and concurrently introduced into the radiation-sensitive layer. In a preferred form, a ballasted coupler is employed which is initially contained within the radiation-sensitive layer with the organic color developer being later introduced. A wide variety of conventional techniques for introducing the dye-image-forming components into the radiation-sensitive layer can be used, ranging from bathing the radiation-sensitive element, after exposure and heating, in dye-forming component solutions to releasing the dye-forming components from pressure-rupturable containers such as pods or micro-encapsulation layers contained in the radiation-sensitive element or a separate element abutted therewith.

A wide variety of oxidizable leuco dyes and oxidizable, dye-forming component combinations are known to the art that can be readily employed in the practice of this invention. Exemplary leuco dyes include aminotriarylmethanes, aminoxanthenes, aminothioxanthenes, amino-9,10-dihydroacridines, aminohydrocinnamic acids (cyanoethanes), aminodiphenylmethanes, aminohydrocinnamic acids (cyanoethanes), leucoindigoid dyes, 1,4-diamino-2,3-dihydroanthraquinones, etc. In addition to these general categories of useful leuco dyes there are numerous other types of amines which can be oxidized to a colored species, such as those set forth in U.S. Pat. Nos. 3,042,515 and 3,042,517, e.g., 4,4'-ethylenedianiline, diphenylamine, N,N-dimethylaniline, 4,4'-methylenedianiline, triphenylamine, N-vinylcarbazole, and the like. Certain hydrazones and acyl derivatives of these hydrazones can be oxidized to diazonium compounds which will then couple with any of a large number of coupling agents to produce an azo dye. Exemplary compounds of this type are disclosed in U.S. Pat. No. 3,076,721, here incorporated by reference. Exemplary of couplers useful with such hydrazones and acyl derivatives thereof are N,N-diethylaniline, N,N-dimethyl-m-toluidine and N-(2-cyanoethyl)-N-methyl-2-naphthylamine. Aromatic diamines in combination with a coupling agent can produce upon oxidation azomethine and indoaniline dyes. Exemplary of N,N-dialkylphenylenediamines, which are preferred for use in the practice of this invention, are N,N-dimethyl-p-phenylenediamine and N,N-dimethyltoluene-2,5-diamine. These amimes are useful with couplers such as 2-acetyl-4'-chloroacetanilide, 2-benzoyl-2'-methoxyacetanilide, o-ethylphenol, 2-naphthol, 7-acetylamino-1-naphthol, N,N-dimethyl-aniline and N,N-diethyl-m-toluidine. Further specific illustrations of oxidizable leuco dyes and dye-forming component combinations useful in the practice of this invention are provided in U.S. Pat. No. 3,383,212, here incorporated by reference.

Instead of utilizing the residual cobalt(III) complex remaining after exposure and heating to form an imaging coloration, it is recognized that the reaction products formed on imaging and/or heating can be employed to form an image within the radiation-sensitive layer, if desired. This approach has the advantage of requiring no additional processing. Any compound can be incorporated which is compatible with the remaining components of the radiation-sensitive layer and which is capable of either being bleached or darkened upon contact with or further reaction with one or more of the reaction products formed on imaging and/or heating. In one form, such a component can be identical to one of the components previously described for incorporation in a separate image-recording layer. For example, a component such as ninhydrin or o-phthalaldehyde can be incorporated which generates a color upon contact with ammonia released as a reaction product upon imaging and/or heating of the radiation-sensitive layer. Alternatively, bleachable dyes, such as the pyrylium, styryl, cyanine, rhodamine and similar conventional dyes known to exhibit color alterations upon contact with a base can be incorporated into the radiation-sensitive layer.

A cobalt(II) compound produced as a reaction product in the course of reducing a cobalt(III) complex in the radiation sensitive layer can, if desired, be used to record images. To be useful in forming an image within the radiation-sensitive layer, it is merely necessary that any cobalt(II) compound formed in exposed areas be visibly distinguishable from the original cobalt(III) complex present in unexposed areas. Typically, cobalt(II) compounds produced as reaction products tend to be substantially colorless so that they are best suited to forming image backgrounds. By choosing a cobalt(III) complex of a distinctly differing hue which is reducible to a substantially colorless cobalt(II) compound, useful positive images can be formed within the radiation-sensitive layer. In the preferred form of the invention, both the cobalt(III) complex, as well as the photoreductant and the oxidation products thereof, are substantially colorless. Cobalt(II) compounds can then be image-wise-generated which form readily discernible, optically dense images by selecting a compound for inclusion in the radiation-sensitive layer which is compatible with the remaining components of the radiation-sensitive layer and which is capable of forming a visible colored cobalt(II) complex as a ligand thereof. We have discovered that it is possible to produce optically dense cobalt(II) compounds useful in forming negative images by incorporating into the radiation-sensitive layer a compound capable of chelating with the cobalt(II) atom formed on reduction of the cobalt(III) complex. In the preferred practice of this invention, the chelating compound is initially present with and chemically compatible with the cobalt(III) complex and the photoreductant within the radiation-sensitive layer.

While a variety of compounds are known to be capable of forming optically dense chelates with cobalt(II) atoms and can be employed in the practice of this invention, preferred chelating compounds include formazan dyes, dithiooxamides, nitroso-arols, azo compounds, hydrazones and Schiff bases. As is well-understood by those skilled in the art, all formazan dyes are capable of forming bidentate chelates and are therefore useful in the practice of this invention. Preferred formazan dyes are those having a ring-bonded, aromatic substituent in the 1 and 5 positions. In formazan dyes, it is unnecessary that either of these aromatic substituents exhibit a ligand-forming capability in order for the dye to exhibit a bidentate chelate-forming capability, but chelate ligand-forming, aromatic substituents can be chosen, if desired, to produce additional chelate ligands. Dithiooxamide is a preferred chelating compound, as well as derivatives thereof having one or both nitrogen atoms substituted with an alkyl, alkaryl, aryl or aralkyl group. Preferred nitroso-arol compounds are those in which the nitroso and hydroxy substituents are adjacent ring position substitutes (e.g., 2-nitrosophenols, 1-nitroso-2-naphthols, 2-nitroso-1-naphthols, etc.). Preferred azo compounds capable of forming at least bidentate chelates with cobalt(II) are those of the general formula:

$$Z^1—N=N—Z^2.$$

Preferred hydrazones capable of fomring at least bidentate chelates with cobalt(II) are those of the general formula:

$$Z^3—CH=N—NH—Z^4.$$

Preferred Schiff bases capable of forming at least bidentate chelates with cobalt(II) are those of the general formula:

$$Z^5—CH=N—Z^6.$$

In the foregoing formulas each of the Z substituents is chosen to be a ring-bonded, aromatic substituent and at least $Z^2$, $Z^3$, $Z^4$, $Z^5$ and $Z^6$ are chosen to be capable of forming a chelate ligand. The aromatic substituents of the ligand-forming compounds can take the form of either homocyclic or heterocyclic single- or multiple-ring substituents, such as phenyl, naphthyl, anthryl, pyridyl, quinolinyl, azolyl, etc. In one form, the aromatic substituent can exhibit a ligand-forming capability as a result of being substituted in the ring position adjacent the bonding position with a substituent which is susceptible to forming a ligand, such as an hydroxy, carboxy or amino group. In another form, the aromatic substituent can be chosen to be an N-heterocyclic aromatic substituent which contains a ring nitrogen atom adjacent the azo bonding position, e.g., a 2-pyridyl, 2-quinolinyl or 2-azolyl (e.g. 2-thiazolyl, 2-benzothiazolyl, 2-oxazolyl, 2-benzoxazolyl, etc.) substituent. The aromatic substituents can, of course, bear substituents which do not interfere with chelating, such as lower alkyl (i.e., one to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyano, azido, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxy (e.g., methylsulfoxy), sulfonium (e.g., dimethyl sulfonium), silyl (e.g., trimethylsilyl) and thioether (e.g., methylthio) substituents. It is generally preferred that the alkyl substituents and substituent moieties have 20 or fewer carbon atoms, most preferably six or fewer carbon atoms. The aryl substituents and substituent moieties are preferably phenyl or naphthyl groups. Exemplary preferred chelate-forming compounds are set forth in Table X.

TABLE X

| Exemplary Chelate-Forming Compounds | |
|---|---|
| CH- 1 | 1,3,5-triphenylformazan |
| CH- 2 | 1-(4-chlorophenyl)-3,5-diphenylformazan |
| CH- 3 | 1-(4-iodophenyl)-3,5-diphenylformazan |
| CH- 4 | 1,5-diphenylformazan |

TABLE X-continued

| Exemplary Chelate-Forming Compounds | |
|---|---|
| CH- 5 | 1,5-diphenyl-3-methylformazan |
| CH- 6 | 1,5-diphenyl-3-(3-iodophenyl)formazan |
| CH- 7 | 1,5-(2-carboxyphenyl)-3-cyanoformazan |
| CH- 8 | 1,5-diphenyl-3-acetylformazan |
| CH- 9 | 1,3-diphenyl-5-(4-diphenyl)formazan |
| CH-10 | 1-(2-hydroxyphenyl)-3,5-diphenylformazan |
| CH-11 | 1-(2-carboxyphenyl)-3,5-diphenylformazan |
| CH-12 | 1-phenyl-3-(3,4-dimethoxyphenyl)-5-(4-nitrophenyl)formazan |
| CH-13 | 1,5-diphenyl-3-(2-naphthyl)formazan |
| CH-14 | 1-phenyl-3-undecyl-5-(4-nitrophenyl)-formazan |
| CH-15 | 1-(2-hydroxy-5-sulfophenyl)-3-phenyl-5-(2-carboxyphenyl)formazan |
| CH-16 | 1,5-diphenyl-3-carbohexoxyformazan |
| CH-17 | 1-(4-methylthiophenyl)-3-(3-nitrophenyl)-5-(3,5-dichlorophenyl)formazan |
| CH-18 | 1-(2-naphthyl)-3-(4-cyanophenyl)-5-(3-nitrio-5-chlorphenyl)formazan |
| CH-19 | 1-(3-pyridyl)-3-(4-chlorophenyl)-5-phenylformazan |
| CH-20 | 1-(2,4,5-trichlorophenyl)-3-phenyl-5-(4-nitrophenyl)formazan |
| CH-21 | 1-(4-pyridyl)-3-phenyl-5-(2-trifluoro-methylphenyl)formazan |
| CH-22 | 1-(12-nitro-4-chlorophenyl)-3-(4-chloro-phenyl-5-(4-phenylazophenyl)formazan |
| CH-23 | 1,3-diphenyl-5-(2-pyridyl)formazan |
| CH-24 | 1-(2,5-dimethylphenyl)-3-phenyl-5-(2-pyridyl)formazan |
| CH-25 | 1-(2-pyridyl)-3-(4-cyanophenyl)-5-(2-tolyl)formazan |
| Ch-26 | 1-(2-benzothiazolyl)-3-phenyl-5-(2-pyridyl)formazan |
| CH-27 | 1-(4,5-dimethylthiazol-3-yl)-3-(4-bromophenyl)-5-(3-trifluoromethyl-phenyl)formazan |
| CH-28 | 1,3-diphenyl-5-(benzothiazol-2-yl)-formazan |
| CH-29 | 1-(benzoxazl-2-yl)-3-phenyl-5-(4-chlorophenyl)formazan |
| CH-30 | 1,3-diphenyl-5-(2-quinolinyl)formazan |
| CH-31 | 2-phenylazophenol |
| CH-32 | 2-phenylazo-5-dimethylaminophenol |
| CH-33 | 2-(2-hydroxyphenylazo)phenol |
| CH-34 | 1-(2-hydroxyphenylazo)-2-naphthol |
| CH-35 | 1-(2-pyridylazo)-2-naphthol |
| CH-36 | 2-(2-pyridylazo)phenol |
| CH-37 | 4-(2-pyridylazo)resorcinol |
| CH-38 | 1-(2-quinolylazo)-2-naphthol |
| CH-39 | 1-(2-thiazolylazo)-2-naphthol |
| CH-40 | 1-(2-benzothiazolylazo)-2-naphthol |
| CH-41 | 1-(4-nitro-2-thiazolylazo)-2-naphthol |
| CH-42 | 4-(2-thiazolylazo)resorcinol |
| CH-43 | 2,2-azodiphenol |
| CH-44 | 1-(3,4-dinitro-2-hydroxyphenylazo)-2,5-phenylene-diamine |
| CH-45 | 1-(2-benzothiazolylazo)-2-naphthol |
| CH-46 | 1-(1-isoquinolylazo)-2-naphthol |
| CH-47 | 2-pyridinecarboxyaldehyde-2-pyridyl-hydrazone |
| CH-48 | 2-pyridinecarboxaldehyde-2-benzothia-zolylhydrazone |
| CH-49 | 2-thiazolecarboxaldehyde-2-benzoxa-zolylhydrazone |
| CH-50 | 2-pyridinecarboxaldehye-2-quinolyl-hydrazone |
| CH-51 | 1-(2-pyridinecarboxaldehyde-imino)-2-naphthol |
| CH-52 | 1-(2-quinolinecarboxaldehyde-imino)-2-naphthol |
| CH-53 | 1-(2-thiazolecarboxyaldehyde-imino)-2-naphthol |
| CH-54 | 1-(2-benzoxazolcarboxaldehye-imino)-2-phenol |
| CH-55 | 1-(2-pyridine carboxaldehyde-imino)-2-phenol |
| CH-56 | 1-(2-pyridinecarboxaldehyde-imino)-2-pyridine |
| CH-57 | 1-(2-pyridinecarboxaldehyde-imino)-2-quinoline |

TABLE X-continued

| Exemplary Chelate-Forming Compounds | |
|---|---|
| CH-58 | 1-(4-nitro-2-pyridinecarboxaldehyde-imino)-2-thiazole |
| CH-59 | 1-(2-benoxazolecarboxaldehyde-imino)-2-oxazole |
| CH-60 | 1-nitroso-2-naphthol |
| CH-61 | 2-nitroso-1-naphthol |
| CH-62 | 1-nitroso-3,6-disulfo-2-naphthol |
| CH-63 | disodium 1-nitroso-2-naphthol-3,6-di-sulfonate |
| CH-64 | 4-nitrosoresorcinol |
| CH-65 | 2-nitroso-4-methoxyphenol |
| CH-66 | dithiooxamide |
| CH-67 | N,N'-dimethyldithiooxamide |
| CH-68 | N,N'-diphenyldithiooxamide |
| CH-69 | N,N'-di-n-hexyldithiooxamide |
| CH-70 | N,N'-di-p-tolyldithiooxamide |

In still another form of this invention, inorganic metal sulfide images can be formed within the radiation-sensitive layer. This can be achieved by incorporating into the radiation-sensitive layer in combination with the cobalt(III) complex and the photoreductant compounds such as those containing one or more thioamide functional groups, e.g., thiourea, thioacetamide and substituted and/or cyclized derivatives thereof. It has also been discovered that the use of a transparent overlayer incorporating one or more thioamide compounds will increase the optical density of images obtained. The overlayer offers the further advantage that it allows greater concentrations of the thioamides to be employed. It has also been observed that superior results are obtained using thioamides to produce images if the radiation-sensitive layer is heated concurrently with exposure. It is recognized that the use of cobalt(III) complex and a photoreductant in combination can be used to enhance the radiation sensitivity and spectral response of radiation-sensitive systems such as those disclosed in U.S. Pat. Nos. 1,897,843, 1,962,307 and 2,084,420, cited above and here incorporated by reference.

All of the compounds added to the radiation-sensitive layer can be introduced similarly as the leuco dye or oxidizable dye-forming component combinations. That is, these image-forming compounds can be added to the radiation-sensitive layer by conventional procedures after imagewise exposure, if desired. To minimize processing, it is generally preferred to incorporate the image-forming compounds capable of reacting with the reaction products formed on exposure directly into the radiation-sensitive layer at the time it is formed. This can be conveniently accomplished by dissolving the image-forming compound within the coating composition used to form the radiation-sensitive layer. While the proportions of the image-forming compounds incorporated within the radiation-sensitive layer can be widely varied, it is generally preferred that the image-forming compound be present in a concentration of from 0.1 to 10 parts per part by weight of cobalt(III) complex initially present in the radiation-sensitive layer. It is specifically recognized that the radiation-sensitive layers and elements having image-forming capabilities can be employed in combination with image-recording layers and elements similar to those radiation-sensitive layers and elements lacking image-recording capabilities.

The practice of the invention is further illustrated by reference to the following examples:

EXAMPLE 180

A coating composition was prepared consisting essentially of 0.3 gram ninhydrin, 0.2 gram 2-isopropoxy-1,4-naphthoquinone (PR-145); 0.1 gram hexa-ammine cobalt(III) acetate (C-1), 0.1 gram water; 6 grams 2-methoxy ethanol, 4 grams acetone; and 0.4 gram cellulose acetate butyrate (HS-10). The coating composition was spread to a wet thickness of approximately 100 microns on a poly(ethylene terephthalate) film support and allowed to dry. The dried coating was exposed imagewise to a high-pressure mercury lamp as a radiation source. A faint brown negative image was formed which greatly intensified upon heating to 115° C. for 5 to 10 seconds.

EXAMPLE 181

The procedure of the preceding Example was repeated, but o-phthalaldehyde was substituted for ninhydrin. Upon heating, a black negative image was formed.

EXAMPLE 182

The procedure of the preceding Example was repeated, but with the substitution of a coating composition consisting essentially of 0.2 gram 2-isopropoxy-1,4-naphthoquinone (PR-145), 0.66 gram μ-superoxodecammine dicobaltate(III) perchlorate (C-20); 0.75 gram cellulose acetate butyrate (HS-10) and 10.0 grams dimethyl formamide. After exposure and heating as in the preceding Example the radiation-sensitive element was immersed in a solution of leuco malachite green in toluene. A green positive image was formed.

EXAMPLE 183

A coating composition was prepared consisting essentially of C-3, 500 mg; CH-43, 65.0 mg; PR-145, 220 mg; HS-10, 1000 mg; and 10 g acetone. A coating was formed using the composition having a wet thickness of 100 microns on a poly(ethylene terephthalate) film support. After drying the coating was imagewise exposed to an ultraviolet and blue radiation source medium pressure mercury arc lamp for 0.5 second. This light source is commercially available under the trademark Micro Master Diazo Copier. The imagewise exposed coating was then heated to 100° C. for 10 seconds by passage between heated rollers. A bright red image was formed in irradiated areas having a density of 1.3.

EXAMPLE 184

A coating composition was prepared consisting essentially of C-15, 210.0 milligrams; CH-35, 120 milligrams; PR-145, 110.0 mg; HS-10, 1000.0 mg; and 10 g acetone. The procedure of the preceding Example was repeated, except that the coating was imagewise exposed for 8 seconds. A magenta image was formed in exposed areas having a density of 1.3.

EXAMPLE 185

A composition was prepared consisting essentially of 20 mg. 4-diethylamino-benzenediazonium tetrafluoroborate PR-29; 100 mg. C-3; and 100 mg o-phthalaldehyde in 10 grams of methyl alcohol. The composition was imbibed in a filter paper and after drying was imagewise exposed for 2 seconds using as a radiation source a medium pressure mercury lamp. This radiation source is commercially available under the trademark Micro Master Diazo Copier. The exposed coating was then heated for approximately 5 seconds at 110° C. A black image was formed in irradiated areas.

EXAMPLE 186

Following the procedure of Example 171, except as otherwise stated, 0.23 gram of C-2 was substituted for 0.2 gram of C-1. A diazo recording element having a transparent base was used of a type commercially available under the trademark KODAK Diazo Type H Film. A negative image was formed in the diazo receiver sheet and a blue negative image was formed in the radiation-sensitive layer.

The invention has been described in detail with particular reference to preferred embodiments thereof, but it will be understood that variations and modifications can be effected within the spirit and scope of the invention.

We claim:

1. A radiation-sensitive element comprising:
(a) a support and,
(b) on the support, a radiation-sensitive layer comprising, in admixture:
a reducible, inert cobalt(III) complex free of a sensitizable anion,
a photoreductant capable of forming, in the absence of a cobalt(III) complex, upon exposure to activating radiation longer than 300 nanometers in wavelength, a reducing agent which forms a redox couple with the cobalt(III) complex when associated therewith, said photoreductant being selected from the group consisting of disulfides, diazoanthrones, diazophenanthrones, aromatic azides, and carbazides, and
(c) a radiation-responsive diazo recording layer overlying said radiation-sensitive layer.

2. An element according to claim 1 and further including at least one ammonia-permeable layer interposed between said radiation-sensitive layer and said diazo recording layer.

3. A radiation-sensitive element comprising:
(a) a support and,
(b) on the support, a radiation-sensitive layer comprising, in admixture:
a reducible, inert cobalt(III) complex free of a sensitizable anion,
a photoreductant capable of forming, in the absence of cobalt(III) complex, upon exposure to activating radiation longer than 300 nanometers in wavelength, a reducing agent which forms a redox couple with the cobalt(III)complex when associated therewith, said photoreductant being selected from the group consisting of:
1-naphthyl disulfide,
β-naphthyl disulfide,
9-anthryl disulfide,
cyclohexyl 2-naphthyl disulfide,
diphenylmethyl 2-naphthyl disulfide,
2-dodecyl 1'-naphthyl disulfide,
thioctic acid,
2,2'-bis(hydroxymethyl)diphenyl disulfide,
10-diazoanthrone,
2-methoxy-10-diazoanthrone,
3-nitro-10-diazoanthrone,
3,6-diethoxy-10-diazoanthrone,
3-chloro-10-diazoanthrone,
4-ethoxy-10-diazoanthrone,
4-(1-hydroxyethyl)-10-diazoanthrone,
2,7-diethyl-10-diazoanthrone, 9-diazo-10-phenanthrone,
3,6-dimethyl-9-diazo10-phenanthrone,
2,7-dimethyl-9-diazo-10-phenanthrone,
4-azidobenzoic acid,
4-nitrophenyl azide,
4-dimethylaminophenyl azide,
2,6-di-4-azidobenzylidene-4-methylcyclohexanone,
2-azido-1-octylcarbamoyl-benzimidazole,
2,5-bis(4-azidophenyl)-1,3,4-oxadiazole,
1-azido-4-methoxynaphthalene,
2-carbazido-1-naphthol,
3,3'-dimethoxy-4,4'-diazidobiphenyl,
2,5-dimethyl-1,4-benzoquinone,
2,6-dimethyl-1,4-benzoquinone duroquinone,
2-(1-formyl-1-methylethyl)-5-methyl-1,4-benzoquinone,
2-methyl-1,4-benzoquinone,
2-phenyl-1,4-benzoquinone,
2,5-dimethyl-6-(1-formylethyl)-1,4-benzoquinone,
2-(2-cyclohexanonyl)-3,6-dimethyl-1,4-benzoquinone,
1,4-naphthoquinone,
2-methyl-1,4-naphthoquinone,
2,3-dimethyl-1,4-naphthoquinone,
2,3-dichloro-1,4naphthoquinone,
2-thiomethyl-1,4-naphthoquinone,
2-(1formyl-2-propyl)-1,4-naphthoquinone,
2-(2-benzoylethyl)-1,4-naphthoquinone,
9,10-phenanthrenequinone,
2-tert-butyl-9,10-anthraquinone,
2-methyl-1,4-anthraquinone,
2-methyl-9,10-anthraquinone,
5,8-dihydro-1,4-naphthoquinone,
5,8-dihydro-2,5,8-trimethyl-1,4-naphthoquinone,
2,5-bis(dimethylamino)-1,4-benzoquinone,
2,5-dimethyl-3,6-bis(dimethylamino)-1,4-benzoquinone,
2,5-dimethyl-3,6-bispyrrolidino-1,4-benzoquinone,
2-ethoxy-5-methyl-1,4-benzoquinone,
2,6-dimethoxy-1,4-benzoquinone,
2,5-dimethoxy-1,4-benzoquinone,
2,6-diethoxy-1,4-benzoquinone,
2,5-diethoxy-1,4-benzoquinone,
2,5-bis(2-methoxyethoxy)-1,4-benzoquinone,
2,5-bis(β-phenoxyethoxy)-1,4-benzoquinone,
2,5-diphenethoxy-1,4-benzoquinone,
2,5-di-n-propoxy-1,4-benzoquinone,
2,5-di-isopropoxy-1,4-benzoquinone,
2,5-di-n-butoxy-1,4-benzoquinone,
2,5-di-sec-butoxy-1,4-benzoquinone,
1,1'-bis(5-methyl-1,4-benzoquinone-2-yl)-diethyl ether,
2-methyl-5-morpholinomethyl-1,4-benzoquinone,
2,3,5-trimethyl-6-morpholinomethyl-1,4-benzoquinone,
2,5-bis(morpholinomethyl)-1,4-benzoquinone,
2-hydroxymethyl-3,5,6-trimethyl-1,4-benzoquinone,
2-(1-hydroxyethyl)-5-methyl-1,4-benzoquinone,
2-(1-hydroxy-n-propyl)-5-methyl-1,4-benzoquinone,
2-(1-hydroxy-2-methyl-n-propyl)-5-methyl-1,4-benzoquinone,
2-(1,1-dimethyl-2-hydroxyethyl)-5-methyl-1,4-benzoquinone,
2-(1-acetoxyethyl)-5-methyl-1,4-benzoquinone,
2-(1-methoxyethyl)-5-methyl-1,4-benzoquinone,
2-(2-hydroxyethyl)3,5,6-trimethyl-1,4-benzoquinone,
2-ethoxy-5-phenyl-1,4-benzoquinone,
2-i-propoxy-5-phenyl-1,4-benzoquinone,
1,4-dihydro-1,4-dimethyl-9,10-anthraquinone,
2-dimethylamino-1,4-naphthoquinone,
2-methoxy-1,4-naphthoquinone,
2-benzyloxy-1,4-naphthoquinone,
2-methoxy-3-chloro-1,4-naphthoquinone,
2,3-dimethoxy-1,4-naphthoquinone,
2,3-diethoxy-1,4-naphthoquinone,
2-ethoxy-1,4-naphthoquinone,
2-phenethoxy-1,4-naphthoquinone,
2(2-methoxyethoxy)-1,4-naphthoquinone,
2-(2-ethoxyethoxy)-1,4-naphthoquinone,
2-(2-phenoxy)ethoxy-1,4-naphthoquinone,
2-ethoxy-5-methoxy-1,4-naphthoquinone,
2-ethoxy-6-methoxy-1,4-naphthoquinone,
2-ethoxy-7-methoxy-1,4-naphthoquinone,
2-n-propoxy-1,4-naphthoquinone,
2-(3-hydroxypropoxy)-1,4-naphthoquinone,
2-isopropoxy-1,4-naphthoquinone,
7-methoxy-2-isopropoxy-1,4-naphthoquinone,
2-n-butoxy-1,4-naphthoquinone,
2-sec-butoxy-1,4-naphthoquinone,
2-n-pentoxy-1,4-naphthoquinone,
2-n-hexoxy-1,4-naphthoquinone,
2-n-heptoxy-1,4-naphthoquinone,
2-acetoxymethyl-3-methyl-1,4-naphthoquinone,
2-methoxymethyl-3-methyl-1,4-naphthoquinone,
2-(β-acetoxyethyl)-1,4-naphthoquinone,
2-N,N-bis(cyanomethyl)aminomethyl-3-methyl-1,4-naphthoquinone,
2-methyl-3-morpholinomethyl-1,4-naphthoquinone,
2-hydroxymethyl-1,4-naphthoquinone,
2-hydroxymethyl-3-methyl-1,4-naphthoquinone,
2-(1-hydroxyethyl)-1,4-naphthoquinone,
2-(2-hydroxyethyl)-1,4-naphthoquinone,
2-(1,1-dimethyl-2-hydroxyethyl)-1,4-naphthoquinone,
2-bromo-3-isopropoxy-1,4-naphthoquinone,
2-ethoxy-3-methyl-1,4-naphthoquinone,
2-chloro-3-piperidino-1,4-naphthoquinone,
2-morpholino-1,4-naphthoquinone,
2,3-dipiperidino-1,4-naphthoquinone,
2-dibenzylamino-3-chloro-1,4-naphthoquinone,
2-methyloxycarbonylmethoxy-1,4-naphthoquinone,
2-(N-ethyl-N-benzylamino)-3-chloro-1,4-naphthoquinone,
2-morpholino-3-chloro-1,4-naphthoquinone,
2-pyrrolidino-3-chloro-1,4-naphthoquinone,
2-diethylamino-3-chloro-1,4-naphthoquinone,
2-diethylamino-1,4-naphthoquinone,
2-piperidino-1,4-naphthoquinone,
2-pyrrolidino-1,4-naphthoquinone,
2-(2-hexyloxy)-1,4-naphthoquinone,
2-neo-pentyloxy-1,4-naphthoquinone,
2-(2-n-pentyloxy)-1,4-naphthoquinone,
2-(3-methyl-n-butoxy)-1,4-naphthoquinone,
2-(6-hydroxy-n-hexoxy)-1,4-naphthoquinone,
2-ethoxy-3-chloro-1,4-naphthoquinone,
2-di(phenyl)methoxy-1,4-naphthoquinone, 2-(2-hydroxyethoxy)-3-chloro-1,4-naphthoquinone,
2-methyl-3-(1-hydroxymethyl)ethyl-1,4-naphthoquinone,
2-azetidino-3-chloro-1,4-naphthoquinone,
2-(2-hydroxyethyl)-3-bromo-1,4-naphthoquinone,
2,3-dimorpholino-1,4-naphthoquinone,
2-ethylamino-3-piperidino-1,4-naphthoquinone,
2-ethoxymethyl-1,4-naphthoquinone, and
2-phenoxymethyl-1,4-naphthoquinone; and (c) a radiation-responsive diazo recording layer overlying said radiation-sensitive layer.

4. An element as defined in claim 3 and further including at least one ammonia-permeable layer interposed between said radiation-sensitive layer and said diazo recording layer.

5. A radiation-sensitive element comprising (a) a support, and (b) on the support, a radiation-sensitive layer comprising, in admixture, a reducible, inert cobalt(III) complex free of a sensitizable anion, a quinone capable of forming in the absence of a cobalt(III) complex, upon exposure to activating radiation longer than 300 nanometers in wavelength, a reducing agent which forms a redox couple when associated with the cobalt(III) complex, said quinone containing one or more labile hydrogen atoms, and (c) a radiation-responsive diazo recording layer overlying said radiation-sensitive layer.

6. An element as defined in claim 5, and further including at least one ammonia-permeable layer interposed between said radiation-sensitive layer and said diazo recording layer.

* * * * *